US005851713A

United States Patent [19]

Hayashi et al.

[11] Patent Number: 5,851,713

[45] **Date of Patent: *Dec. 22, 1998**

[54] TONER FOR DEVELOPING AN ELECTROSTATIC LATENT IMAGE

[75] Inventors: Kenji Hayashi; Mikio Koyama; Tomoe Kikuchi, all of Hino; Hiroshi Yamazaki, Hachioji; Naohiro Hirose, Hino; Shinichi Suzuki, Hino; Tsutomu Iwamoto, Hino; Yoshiki Nishimori, Hino, all of Japan

[73] Assignee: Konica Corporation, Japan

[ * ] Notice: The term of this patent shall not extend beyond the expiration date of Pat. No. 5,830,617.

[21] Appl. No.: 724,063

[22] Filed: Sep. 30, 1996

[30] Foreign Application Priority Data

| | | | |
|---|---|---|---|
| Oct. 2, 1995 | [JP] | Japan | 7-255021 |
| Nov. 16, 1995 | [JP] | Japan | 7-298355 |
| Dec. 26, 1995 | [JP] | Japan | 7-339107 |
| Feb. 28, 1996 | [JP] | Japan | 8-041468 |

[51] Int. Cl.[6] ..... G03G 9/08

[52] U.S. Cl. ..... 430/109; 430/106; 430/111; 430/903

[58] Field of Search ..... 430/111, 109, 430/106, 903

[56] References Cited

U.S. PATENT DOCUMENTS

| | | | |
|---|---|---|---|
| 5,219,697 | 6/1993 | Mori et al. | 430/110 |
| 5,439,770 | 8/1995 | Taya et al. | 430/106 |
| 5,460,914 | 10/1995 | Sasaki et al. | 430/109 |
| 5,538,830 | 7/1996 | Swidler | 430/115 |
| 5,641,603 | 6/1997 | Yamazaki et al. | 430/124 |

FOREIGN PATENT DOCUMENTS

| | | | |
|---|---|---|---|
| 6-329947 | 11/1994 | Japan | C09C 3/10 |

OTHER PUBLICATIONS

Sodeyama et al., "Non–Spherical Particles and the Production Method", English translation of JP 6–329947, Nov. 29, 1994.

*Primary Examiner*—Christopher D. Rodee
*Assistant Examiner*—Steven H. VerSteeg
*Attorney, Agent, or Firm*—Jordan B. Bierman; Bierman, Muserlian and Lucas

[57] ABSTRACT

Disclosed is a toner for developing an electrostatic latent image, said toner having a BET specific surface area of not less than $5m^2/g$ and a particle size distribution (2SD) of not more than 5 $\mu$m.

15 Claims, 5 Drawing Sheets

TONER FOR DEVELOPING AN ELECTROSTATIC LATENT IMAGE

FIELD OF THE INVENTION

The present invention relates to a toner for developing an electrostatic latent image having a stable charging performance, high development speed, excellent durability and reduced fogging.

BACKGROUND OF THE INVENTION

Recently, an electrophotography development system has been utilized in various fields including, not only a copying machine, but also printers which serves as an outputting terminal for computers, color copying machines and color printers. Accordingly, increased image quality has been demanded, resulting in higher performance of the inherent toner.

Various technologies for improving image quality by reducing the size of the toner particles have been disclosed. However, in the case of conventional smaller particle toners, it merely reduces the size of the toner particles. Due to this, adhesion forces due to van der Waals force increases. Therefore, it is difficult to impart the desired charging property to the toner. In addition, due to the existence of a weak charging property and the presence of toner wherein the degree of charging is excessive, durability is reduced as follows: fogging occurs on an image when used for a long time, and, in addition, contamination on a developing device or on a carrier in a two-component development occurs. The above-mentioned problems noticeably occur in toner wherein the size of particles has been reduced. However, they appear in toner having particle size put into practical use. In addition, in an image forming system wherein high speed, high image quality and high durability are required as in recently, defects derived from the above-mentioned problems have been prominent.

In addition, due to an increase in the toner's adhesion force due to downsizing of particle size, if conventional particle-downsized toner is used, problems that transfer performance is reduced and that the cleaning capability of untransferred toner remaining on the photoreceptor is reduced, have occurred.

In addition, in order to prevent the occurrence of the offset phenomenon in heat roller fixing method, a technology to supply a dimethyl silicone oil on the surface of a fixing rollers has been proposed.

The above-mentioned method is effective for preventing the occurrence of the offset phenomenon. However, since a large amount of dimethyl silicone oil is necessary, a device for supplying the silicone oil is required. In addition, oil contamination on the fixed image easily occurs. In addition, when a sheet for an overhead projector is used, oil contamination by the above-mentioned silicone oil particularly easily occurs when the toner is fixed.

It is the current situation that there is no technology to prevent the occurrence of the offset phenomenon while forming an image excellent in terms of luster as a color image.

In addition, in order to improve color image quality, there is a need for the color toner to form an image excellent in transparency from viewpoint of improving the color tone of the image. Accordingly, in order to improve the transparency of the image, methods of dyeing particles as shown in Japanese Patent Publication Open to Public Inspection (hereinafter, referred to as Japanese Patent O.P.I. Publication) Nos. 46333/1975, 291360/1992 and 243267/1992 and a method of using an oil-soluble dye as shown in Japanese Patent O.P.I. Publication No. 295069/1987 have been disclosed.

However, solubilities of oil-soluble dyes in resins are different from each other. Depending upon the kind of resin, coagulation occurs so that it has been difficult to keep transparency.

Heretofore, in the electrophotographic method, a heat roller fixing method has been applied on the ground that the heat efficiency of a toner image carried by a recording medium is favorable and that it is suitable for high speed fixing. In the above-mentioned heat roller fixing method, a toner is heat-fused and then fixed on the recording paper after passing the recording paper carrying the toner image through a fixing roller wherein a heat source is built-in and a pressure roller.

Though the above-mentioned heat roller fixing method has the above-mentioned advantage, depending upon the kind of toner used, it easily causes so-called offset phenomenon wherein the toner is transferred to the fixing roller, is adhered at another place on the recording paper after rotation of the roller and is fixed so that the image on the resulting recording paper is contaminated.

For example, resins having narrow molecular weight distribution in the toner are excellent in sharp melting. Therefore, an image excellent in luster as the color image can be formed. However, the offset phenomenon easily occurs as described above.

Therefore, many technologies to provide an anti-offsetting property in toner itself have been proposed. A technology to use a resin having a wide molecular weight distribution is disclosed in Japanese Patent O.P.I. No. 134652/1975 and a technology to add a releasing agent such as a low-molecular-weight polypropylene to the toner is disclosed in Japanese Patent O.P.I. No. 65231/1984.

Though the above-mentioned technologies offer excellent effects for preventing the occurrence of the offsetting phenomenon, the resin having a wide molecular weight distribution has poor solubility and the sharp melting property is deteriorated so that the fixing property is not sufficient. Specifically, when evaluating the color image, an image having no luster wherein many unevennesses occur on the surface of the image is formed. Therefore, when comparing with a resin having narrow molecular weight distribution, the difference in terms of color image property is so large that it is very difficult to obtain an image having no image defect.

In order to improve the fixing performance, by adding polyolefin, attempts to increase the added amount of polyolefin and to use polyolefin having lower melting point were made. However, such technologies had a problem in that fusing easily occurs in the crusher or a classifying machine.

SUMMARY OF THE INVENTION

To solve the above-mentioned problems, a first object of the present invention is to provide toner for developing an electrostatic latent image having stable charging property wherein the occurrence of weak charging toner is small even when the size of toner particle is reduced and the occurrence of toner with excessive charging is small.

A second object of the present invention is to provide toner for developing electrostatic latent image having high development speed, excellent durability and no occurrence of fogging.

A third object is to provide an image forming method using the above-mentioned toner appropriately.

A fourth object is to provide toner for developing electrostatic image having no occurrence of offset development while forming an image excellent in luster as a color image and an image forming method using the same.

A fifth object is to provide toner having small particle size and excellent transparency and a manufacturing method thereof.

A sixth object of the present invention is to provide toner for developing electrostatic latent image wherein the temperature region where no offset occurs is wide and adhesion of residual toner which occurs due to offset from the fixing roller is small.

The above-mentioned objects of the present invention will be attained by the following items.

(1) A toner for developing an electrostatic latent image wherein the BET specific surface area is not less than 5 $m^2/g$ and, a particle size distribution of said toner is 2SD≦5 μm.

(2) A developer containing toner for developing electrostatic latent image wherein the BET specific surface area is not less than 5 $m^2/g$ and, a particle size distribution of said toner is 2SD≦5 μm.

(3) An image forming method which visualizes the electrostatic latent image formed on a photoreceptor as toner image, wherein the above-mentioned toner is toner for developing an electrostatic latent image in which the BET specific surface area is not less than 5 $m^2/g$ and, a particle size distribution of said toner is 2SD≦5 μm.

(4) An image forming method which transfers toner image formed on the photoreceptor to a transfer material, wherein the above-mentioned toner is toner for developing electrostatic latent image in which the BET specific surface area is not less than 5 $m^2/g$ and, particle size distribution is of said toner 2SD≦5 μm.

(5) An image forming method which, after transferring toner image formed on an image support to a transfer material, toner remaining on aforesaid image support is removed for cleaning, wherein the above-mentioned toner is toner for developing electrostatic latent image in which the BET specific surface area is not less than 5 $m^2/g$ and, a particle size distribution is of said toner 2SD≦5 pm.

(6) The toner for developing electrostatic image described in item (1), said toner contains resin and a colorant and said resin satisfies the following relationship.

Weight average molecular weight (Mw)/

Number average molecular weight (Mn)≦5

(7) An image forming method which passes a recording medium carrying toner image containing at least a resin and a colorant between a fixing member in which a releasing agent is coated and a pressure member which is contact with the above-mentioned fixing member for rotation and which fixes the toner image onto the recording medium through the above-mentioned fixing member by a heating member located fixingly, wherein the above-mentioned resin satisfies the following relationship and the above-mentioned releasing agent is a fluorine-containing silicone oil having a structural unit represented by Formula [I].

Weight average molecular weight (Mw)/

Number average molecular weight (Mn)≦5

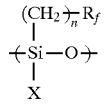

Formula [I]

wherein X represents an alkyl group having 1–4 carbon atoms or an aryl group; $R_f$ represents a fluoroalkyl group having 2–10 carbon atoms; and n represents an integer of 1–4.

(8) The toner for developing electrostatic latent image described in item (1), wherein said toner contains styrene polymer and an oil-soluble dye has a solubility in toluene is not less than 0.01 g/100 ml of toluene and a solubility an water is not more than 0.1 wt %. (9) A developer for developing electrostatic latent image wherein toner and a carrier described in item (8) is contained. (10) An image forming method which visualizes electrostatic latent image formed on the photoreceptor as toner image, wherein the above-mentioned toner contains styrene polymer an oil-soluble dye having a solubility of not less than 0.01 g/100 ml of toluene and a solubility in water is not more than 0.1 wt % and the BET specific surface area is not less than 5 $m^2/g$.

(11) A manufacturing method of toner for developing electrostatic latent image containing a styrene polymer and a dye, wherein said toner is formed by coagulating resin particles composed of a styrene polymer prepared by an emulsification polymer method, the above-mentioned dye contains an oil-soluble dye having a solubility of not less than 0.01 g/100 ml of toluene and a solubility in water is not more than 0.1 wt % and the BET specific surface area is not less than 5 $m^2/g$.

(12) Toner for developing an electrostatic latent image, wherein said toner contains polyolefin having a polar group in a molecule and BET specific surface area of said toner is not less than 5 $m^2/g$.

(13) A developer comprising a toner containing polyolefin having a polar group in a molecule wherein BET specific surface area of said toner is not less than 5 $m^2/g$, and a carrier.

(14) An image forming method wherein a latent image formed on an electrostatic latent image is developed by a toner for developing an electrostatic image containing polyolefin having a polar group in a molecule wherein BET specific surface area is not less than 5 $m^2/g$.

(15) An image forming method which passes a recording medium carrying toner image containing at least a resin and a colorant between a movable fixing member and a pressure member which is contact with the above-mentioned fixing member while rotating and which fixes the toner image onto the recording medium through the above-mentioned fixing member by a heating member located fixingly, wherein the above-mentioned toner contains polyolefin having a polar group in a molecule and the BET specific surface area of said toner is not less than 5 $m^2/g$.

DETAILED DESCRIPTION OF THE INVENTION

Figure 1:
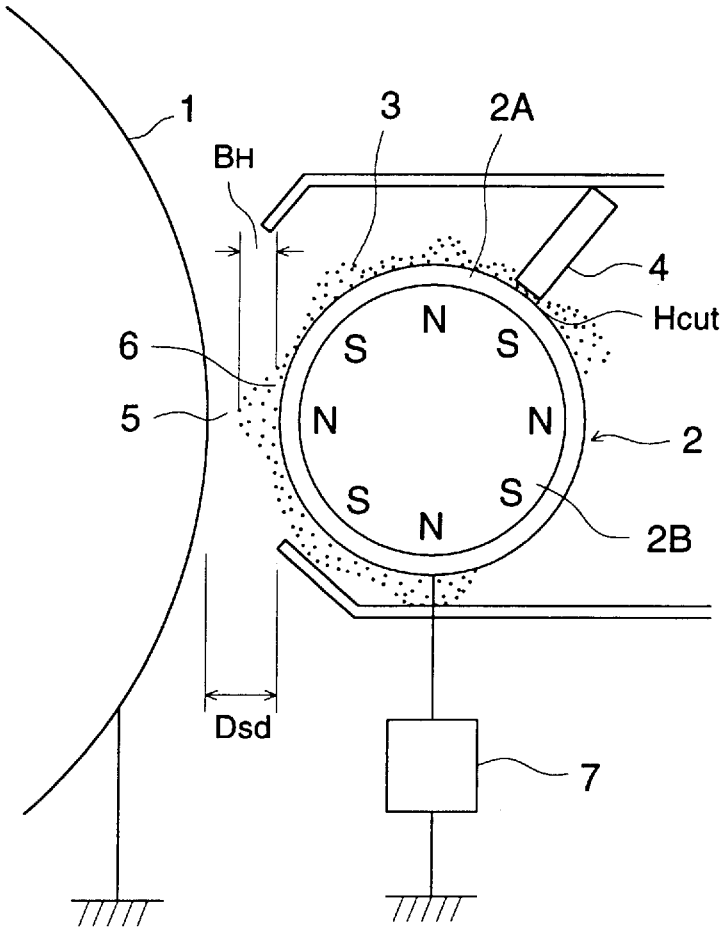
FIG. 1 is a schematic view showing one example of a non-contact developing system.

Hereinafter, the present invention will be explained concretely.

Explanation of Toner of the present invention

Toner for developing an electrostatic latent image of the present invention (hereinafter, referred to as "toner of the present invention") wherein the BET specific surface area is not less than 5 $m^2/g$ and particle size distribution is 2SD<5 $\mu$m 5 $\mu$m (SD represents a standard deviation) is necessary. Toner having a great specific surface area as above is not conventionally known. The present inventors discovered that toner having great specific surface area has excellent charging property, developability and durability. Formerly, they filed Japanese Patent Application No. 136716/1995 (filed on Jun. 2, 1995). The present inventors continued further investigation about the toner having great specific surface area, and discovered that the toner having the above-mentioned standard deviation is excellent in charging property, developability and durability specifically among the above-mentioned toners so that the present invention was completed.

The toner of the present invention has great specific surface area and, concurrently with this, also has narrow particle size distribution. It is assumed that the reason why the toner of the present invention has excellent effects compared to toner having only great specific surface area is that adhesion force due to van del Waals force is large, weak charging toner does not exist and toner having great particle size does not exist so that excessive or too weak charging toner does not exist since particle size distribution is so narrow that toner having small particle size does not exist. As described above, excellent effects provided by the toner of the present invention was so great as was not been foreseen by conventional toner having small specific surface area. The average particle size of the toner of the present invention is ordinarily 1–10 $\mu$m and preferably 2–8 $\mu$m.

(1) Constitution of toner and the manufacture method thereof

One of the features of the toner of the present invention is to have the BET value specific surface area of not less than 5 $m^2/g$. From technical viewpoint, it is sufficient to be not more than 150 $m^2$, preferably not more than 100 $m^2$ and specifically preferably 5–50 $m^2/g$. More preferably, 5–40 $m^2/g$ and particularly preferably 10–40 $m^2/g$. The above-mentioned BET specific surface area is measured by the one point method of the nitrogen adsorption method. Specifically, as a measuring instrument, Flow Sorb 2300 (produced by Shimadzu Seisakusho) is used.

In the present invention, a particle size distribution of the toner is defined by 2SD, and another feature of the toner of the present invention is to have particle size distribution of 0<2SD<5 Wm. Here, SD represents a standard deviation. In the present invention, the particle size distribution is necessary to be $0 \leqq 2SD \leqq 5$ $\mu$m. Preferably, $0 \leqq 25D$ $\mu m \leqq 3$ $\mu$m.

In the present invention, the standard deviation is the standard deviation of particle size ($D_{50}$) of toner particles when the cumulative population is 50%, and it is defined by the following equation.

Equation $$\text{Standard Deviation } (SD) = \sqrt{\frac{\sum_i (X_i - D_{50})^2 \cdot y}{\sum_i y_i}}$$

wherein $X_i$ is particle size in area i; $D_{50}$ represents particle size when the cumulative population is 50%; and $$\sum_j y_i$$

represents volume basis distribution.

The toner of the present invention is preferably those containing at least a resin and a colorant. As necessary, it may contain a releasing agent and a charge controlling agent which are agents for improving fixing. In addition, those wherein additives consist of inorganic fine particles and organic fine particles may be used.

The toner of the present invention can be manufactured as follows. Namely, in the toner of the present invention, for example, an additive necessary for a monomer is mixed to be emulsified and polymerized so that polymer particles composed of fine particles is manufactured. Following this, an organic solvent and a coagulation agent are added to be associated.

In the present invention, due to an image forming method which adopted a composition in which a resin having narrow molecular weight distribution, namely a resin having small Mw/Mn is used for toner for developing electrostatic latent image and, concurrently with this, a fluorine-containing silicone oil having a structural unit illustrated by the above-mentioned Formula is coated on a fixing member, the occurrence of offset phenomenon is prevented while forming an image excellent in luster as a color image.

First, a fluorine-containing silicone oil having a structural unit illustrated by Formula I (hereinafter, simply referred to as a fluorine-containing silicone oil) will be explained.

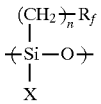

Formula I wherein X represents an alkyl group having 1–4 carbon atoms or an aryl group; $R_f$ represents a fluoroalkyl group having 2–10 carbon atoms and preferably a group represented by $Z—(CF_2)_m—$ (wherein Z represents a hydrogen atom or a fluorine atom, and m represents an integer of 2–10); $R_f$ preferably represents a fluoroalkyl group having 2–8 carbon atoms; n represents an integer of 1–4; m represents an integer of 2–10; and m preferably represents an integer of 2–8.

The fluorine-containing silicone oil is necessary to have the above-mentioned repeating unit. It may have a copolymer structure with a dimethyl silicone, phenylmethyl silicone or a diphenyl silicone. It is essential that the fluorine-containing silicone oil is liquid having an appropriate viscosity when being used. Accordingly, its viscosity is preferably 20–1000 cp and preferably 100–500 cp at 25° C. The above-mentioned viscosity can be regulated by adjusting the degree of polymerization. This viscosity represents a dynamic viscosity, which can be measured by an Ubbelohde viscosity meter in accordance with ASTM D 445-46T or JIS Z8803.

When the fluorine-containing silicone oil is a copolymer, it is preferable that a structural unit illustrated by Formula I is contained in an amount of not less than 20 mol %, from viewpoint of the degree of achieving various objects of the present invention. If less than the above-mentioned value, the effects of the fluorine-containing silicone oil cannot be provided, and the effects of the other components are noticeably provided.

The manufacturing method of the fluorine-containing silicone oil is as follows. Namely, in the same manner as in production method of ordinary silicone oil, Dialkyl-substituted dichlorosilane is regulated by reaction of silicone and alkyl chloride. By hydrolyzing it, siloxane is produced. Following this, a cyclic oligomer or a linear oligomer is formed, and then, they are polymerized. Thus, the fluorine-containing silicone oil is synthesized. The fluorine-containing silicone oil has a fluorinated alkyl group at the side chain. In this case, however, by the use of a fluorine-containing compound having a chloro group at the end in place of alkyl chloride, for example, by the use of a compound represented by the following Formula, the fluorine-containing silicone oil can easily be manufactured.

$$Z—(CF_2)_m(CH_2)_nCl$$

wherein Z, m and n respectively represent those described as above.

Practically, compounds having the following structures are cited.

(A) $CF_3CF_2CH_2Cl$
(B) $CF_3(CF_2)_2CH_2Cl$
(C) $CF_3(CF_2)_2(CH_2)_2Cl$
(D) $CF_3(CF_2)_2(CH_2)_3Cl$
(E) $CF_3(CF_2)_3CH_2Cl$
(F) $CF_3(CF_2)_4(CH_2)_3Cl$
(G) $CF_3(CF_2)_5CH_2Cl$
(H) $CF_3(CF_2)_6CH_2Cl$
(I) $H(CF_2)_2CH_2Cl$
(J) $H(CF_2)_3CH_2Cl$
(K) $H(CF_2)_3(CH_2)_2Cl$
(L) $H(CF_2)_4CH_2Cl$
(M) $H(CF_2)_4(CH_2)_2Cl$
(N) $H(CF_2)_4(CH_2)_4Cl$
(O) $H(CF_2)_5(CH_2)_3Cl$
(P) $H(CF_2)_6CH_2Cl$

Incidentally, as alkyl chloride wherein an alkyl group other than a fluorinated alkyl group is introduced, methyl chloride, ethyl chloride, propyl chloride and butyl chloride can be cited.

It is assumed that, the above-mentioned fluorine number will provide noticeable effects in order to provide effects such as uniform adherence on a fixing roll laminated with a fluorine-containing resin by the use of a silicone oil substituted with the above-mentioned fluorinated alkyl. In such occasions, the number of carbon atom in fluorinated alkyl is 1–10 and preferably 2–8. In addition, it is also preferable that a portion directly bound to the silicon atom is preferably a methylene chain. In addition, if the carbon number in the above-mentioned fluorinated alkyl carbon is excessive, a problem occurs in fluidity characteristics when heat is applied.

If the fluorine-containing silicone oil does not have a fluorinated alkyl, there is no improvement in terms of wettability against the surface of heat roll covered with a fluorine-containing resin so that uniform oil layer cannot be formed.

Structure of the fluorine-containing silicone oil will be exemplified as follows.

(1) Viscosity: 450 cp

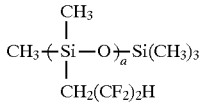

(2) Viscosity: 250 cp

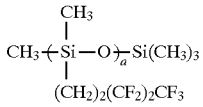

(3) Viscosity: 300 cp

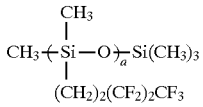

(4) Viscosity: 500 cp

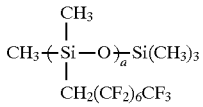

(5) Viscosity: 350 cp

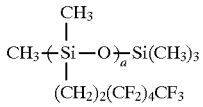

(6) Viscosity: 320 cp
a:b = 80:20

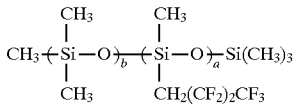

(7) Viscosity: 300 cp
a:b = 60:40

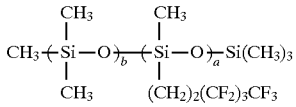

(8) Viscosity: 300 cp
a:b = 70:30

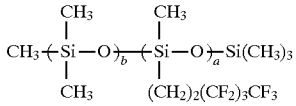

(9) Viscosity: 300 cp
a:b = 80:20

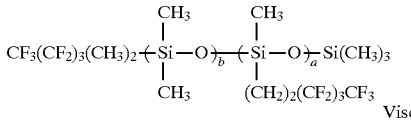

(10) Viscosity: 450 cp
a:b = 50:50

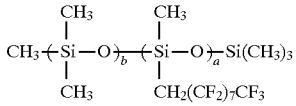

(11) Viscosity: 200 cp
a:b = 30:70

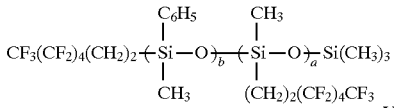

(12) Viscosity: 500 cp
a:b = 90:10

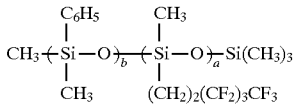

(13) Viscosity: 300 cp
a:b = 80:20

-continued

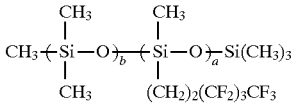

Incidentally, a and b represent an integer of not less than 1. Preferably, an integer of 10–1000, more preferably 20–100. In addition, a+b is not specifically limited. However, 40–150 is preferable.

The toner for developing electrostatic latent image of the present invention (hereinafter, referred to as "toner of the present invention") preferably (1) has the BET specific surface area of not less than 5 $m^2/g$ and (2) contains polyolefin having a polar group in its molecule.

With regard to a polar group, it is preferable that an arbitrary polar group such as a sulfo group, a phospho group, a carboxyl group or their alkali metal and salts of alkali earth metals. In the present invention, as a method for introducing a polar group in a polyolefin molecule, the following method is cited.

In the present invention, as a polyolefin having a polar group in a molecule, a polymer of an olefin component and an olefin component having a polarity as acid or an oxidized product of polyolefin are preferably used. Practically, those composed of a graft copolymer of polyolefin and a polymer unsaturated compound such as those having polarity including an acrylic acid, a methacrylic acid, a maleic acid, an itaconic acid, a citraconic acid, a fumaric acid and an aconitic acid, or an oxidized product obtained by oxidizing polyolefin (a carboxyl group) are cited.

As the above-mentioned olefin component, for example, α-olefin (those having 2–8 carbon atoms such as ethylene, propylene, 1-butene, 4-methyl-1-pentene, 1-hexane and 1-octene), homologs wherein the position of unsaturated binding is different (2-butene, 2-pentene and 3-hexene) and admixtures of two or more kind of the above are cited. Of these, an olefin is preferable and preferably among them, propylene is particularly preferable.

As the above-mentioned olefin component, a copolymer containing a monomer other than olefin may be used. As a monomer other than the above-mentioned olefin, for example, vinyl ethers, vinyl esters, unsaturated carboxylic acid ester and unsaturated carboxylic acid can be mentioned.

As for an addition method of polyolefin having a polar group in a molecule, when the toner of the present invention is prepared by an emulsification polymerization method it is ordinary to emulsify and disperse polyolefin having the abovementioned polar group in a molecule into water and to add it to the toner in the same manner as in a colorant. In order to emulsify and disperse polyolefin having a polar group in its molecule into water, polyolefin having aforesaid polar group in a molecule, a surfactant and a hydroxide for regulating pH were put into a pressure kettle. Pressure is applied to the mixture under high speed stirring so that the temperature is raised up to a softening point of the polyolefin having a polar group in a molecule.

In detail, manufacturing of polyolefin (composed of a graft copolymer) having a polar group in its molecule is conducted by graft copolymerizing the above-mentioned polymeric unsaturated compound with polyolefin using an organic peroxide. The polyolefin having the above-mentioned polar group in its molecule is disclosed in Japanese Patent O.P.I. Publication No. 46689/1973 and Japanese Patent Examined Publication No. 17005/1982.

In addition, as for polyolefin (oxidized product) obtained by oxidizing polyolefin is manufactured by oxidizing polyolefin with oxygen or an oxygen-containing gas (gas). The polyolefin having the above-mentioned polar group in its molecule is disclosed in U.S. Pat. Nos. 2,879,238 and 3,692,877 and Japanese Patent Examined Publication No. 9367/1968.

In the present invention, as for the polyolefin having a polar group in its molecule the content of polyolefin having a polar group namely polarity such as acid against polyolefin can be represented by acid number. The preferable range is not more than 100 mg KOH/g and more preferably not more than 50 mg KOH/g. The above-mentioned acid number is measured by a measuring method disclosed in JIS K 0070.

The added amount of polyolefin having the above-mentioned polar group in its molecule in the toner of the present invention is preferably 0.1–15 pats by weight and more preferably 1–10 pats by weight against 100 parts by weight of aforesaid toner.

In the toner of the present invention, the domain size of polyolefin having the above-mentioned polar group in its molecule is preferably 10–1000 nm, and more preferably 50–500 nm. If the domain size is not more than 10 nm, peeling effect of the toner and the fixing rollers is so small that offset property is insufficient. In addition, if the domain size is 1000 nm or more, uniform dispersion of polyolefin having the above-mentioned polar group in its molecule in toner particles is not sufficient. In addition, peeling effect of the toner particles and the fixing roller is not sufficient.

When measuring the domain size of polyolefin in toner, toner is enclosed with a resin, the resulting was cut into thin chips by means of a microtome, the thin chip is photographed with a transmission electron microscope and the domain size is measured by the use of an image analyzing apparatus. Practically, a microtome (Ultracut E, produced by Reichert-Jung Co.), a transmission electron microscope (LEM-2000, produced by Topcom Co., Ltd.) and an image processing apparatus (SUPICCA, produced by Nihon Abionics Co., Ltd.) are cited. Incidentally, size was represented by the average value in terms of an area size corresponding to a circle.

The weight average molecular weight of polyolefin having the above-mentioned polar group in its molecule (Mw) is ordinarily 500–50,000 and preferably 1000–40,000.

Methods to manufacture toner of the present invention are disclosed in Japanese Patent O.P.I. Publication Nos. 265252/1993 and 329947/1994 and Japanese Patent Application No. 223953/1994. A method to coagulate plural colored polymer fine particles constituted of a resin and a colorant, specifically a method to process the above-mentioned colored polymer fine particles with an organic solvent which infinitely dissolves in water and a coagulator of more than a critical coagulation density is preferably used. In addition, by heating and fusing the formed polymer at its glass transition point temperature (hereinafter, referred to as Tg) or higher, toner having the BET specific surface area of the present invention can be formed.

In the same manner, conventional agents are used as charge control agents. However, there may be cases when the charge control agent is not necessary if a monomer having a polar group on the surface of colored particles is copolymerized. The polar group referred to as here includes groups having plus or minus charge such as a carboxyl group, a sulfonic acid group, an amino group and an ammonium salt group.

As a plus-charging charge control agent, niglosine electron donating dyes, metal salts of naphtenic acid or a higher fatty acid, alkoxylated amine, quaternary ammonium salts, alkylamide, metallic complex, pigments and fluorine processing active agents are cited. As a minus-charging charge control agent, electron-accepting organic complex, chlorinated paraffin, chlorinated polyester and sulfonylamine of copper phthalocyanine are cited.

As for an external additive, for example, fine particles of a fluidizing agent, a charge control agent and a lubricant are included. As for a fluidizing agent, inorganic fine particle such as hydrophobic silica, titanium oxide, alumina and their sulfides, nitrides and silicon carbide are preferably employed. It is further preferable that the above-mentioned inorganic fine particles are subjected to hydrophobicity providing processing by means of a silane coupling agent and a titanium coupling agent. As a charge control agent polyvinylidene fluoride, polystyrene powder, polymethylmethacrylate powder and polyethylene fine particles can be mentioned.

A method to manufacture toner of the present invention is, as described above, not limited specifically. However, preferably, methods disclosed in Japanese Patent O.P.I. Publication No. 265252/1993 and Japanese Patent Application Nos. 116672/1993, 223953/1994 are used. A method to coagulate plural fine particles constituted of a resin and a colorant, specifically a method to process the above-mentioned colored polymer fine particles with a coagulator of more than a critical coagulation density and an organic solvent which infinitely dissolves in water after dispersing fine particles by the use of the above-mentioned emulsifier is preferably used. In addition, by heating and fusing the formed polymer at its glass transition point temperature (hereinafter, referred to as Tg) or higher, toner having-the BET specific surface area of the present invention and the particle distribution of the present invention can be formed.

Concretely, those preferably used as a monomer constituting a resin include styrene or styrene derivatives such as styrene, o-methylstyrene, m-methylstyrene, p-methylstyrene, p-chlorostyrene, 3,4-dichlorostyrene, p-phenylstyrene, p-ethylstyrene, 2,4-dimethylstyrene, p-tbutylstyrene, p-n-hexylstyrene, p-n-octylstyrene, p-n-nonylstyrene, p-n-decylstyrene and p-n-dodecylstyrene, aromatic vinyl compounds such as vinylnaphthalene, methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate, α-methylene aliphatic monocarboxylic acid esters of acrylic acid ester derivatives such as methyl acrylate, ethyl acrylate, isopropyl acrylate, n-octyl acrylate, 2-ethylhexyl acrylate, stearyl acrylate, lauryl acrylate and phenyl acrylate, olefins such as ethylene, propylene isobutylene, halogen-containing vinyls such as vinyl chloride, vinylidene chloride, vinyl bromide, vinyl fluoride and vinylidene fluoride, vinyl esters such as vinyl propionate, vinyl acetate and vinyl benzoate, vinyl ethers such as vinyl methyl ether and vinyl ethyl ether, vinyl ketones such as vinylmethylketone, vinylethyl ketone and vinylhexylketone, N-vinyl compounds such as N-vinyl carbazole, N-vinyl indole and N-vinyl pyrrolidone, vinyl compounds such as vinyl naphthalene and vinyl pyridine and acrylic acid derivatives or methacrylic acid derivatives such as acrylonitrile, methacrylonitrile and acrylic amide. Of the above-mentioned monomers, copolymers wherein an aromatic vinyl compound and an α-methylene aliphatic acid derivative are used in combination are preferably used.

The above-mentioned vinyl-containing monomer may be used independently, or two or more thereof may be used in combination. It is further preferable to use it with those having an ionic dissociation group as a monomer constituting a resin in combination. Particularly, it is preferable to use an aromatic vinyl compounds with an α-methylene aliphatic monocarboxylic acid esters. As an ionic dissociation group, those having substituent such as a carboxyl group, a sulfo group, a phospho group or their salts as a constituting group of a monomer are cited. Practically, acrylic acid, methacrylic acid, maleic acid, itaconic acid, cinnamic acid, fumaric acid, maleic acid monoalkylester, itaconic acid monoalkyl ester, styrene sulfonic acid, alylsulfo citric acid, 2-acrylic amide-2-methylpropane sulfonic acid, acid phospho oxy ethyl methacrylate and 3-chloro-2-acid phospho oxy propyl methacrylate can be cited.

In addition, as a monomer, multi-functional vinyls such as divinylbenzene, ethyleneglycol dimethacrylate, ethyleneglycol diacrylate, diethylene glycol dimethacrylate, diethylene glycol diacrylate, triethylene glycol dimethacrylate, triethylene glycol diacrylate, neopentyl glycol dimethacrylate and neopentylglycol diacrylate can be used to form a resin having a bridge-structure.

The above-mentioned monomer can be polymerized by the use of a radical polymerization initiator to form a resin. In this occasion, an oil-soluble polymerization initiator can be used in accordance with a suspension polymerization method and a solution polymerization method. As the above-mentioned oil-soluble polymerization initiator, azoisobutylonitrile, lauryl peroxide and benzoyl peroxide can be used. In addition, when an emulsification polymerization method is used, a water-soluble radical polymerization initiator can be used. As the water-soluble radical polymerization initiator, persulfate salt such as potassium persulfate and ammonium persulfate, azobisaminodipropane acetic acid salt, azobiscyano valeric acid and its salt and hydrogen peroxide can be cited.

In the present invention, as for an excellent resin, those having the glass transition point of 20°–90° C. are preferable, and those having the softening point of 80°–220° C. or preferable. The glass transition point can be measured by a differential scanning calorimetric analyzing method. The softening point can be measured by a depression type flow tester. As a resin, those whose the number average molecular weight (Mn) is 1,000–100,000 and the weight average molecular weight (Mw) is 2,000–1,000,000 each measured by a Gel Permeation Chromatography are preferable. In addition, as for a molecule weight distribution, those whose Mw/Mn is 1.5–100, particularly 1.8–70 are preferable.

When the toner of the present invention is preferably manufactured, there is no specific limit to the kind of coagulant used. However, those selected from a metal salt is preferably used. Practically, as a monovalent metal, salts of alkaline metal such as sodium, potassium and lithium are cited. As a divalent metal, metallic salts of alkaline earth metal such as calcium and magnesium and divalent metallic salts such as manganese and copper are cited. In addition, salts of trivalent metal such as aluminum are cited. As practical salts, sodium chloride, potassium chloride, lithium chloride, calcium chloride, zinc oxide, copper sulfate, magnesium sulfate and manganese sulfate are cited. These may be used in combination.

The above-mentioned coagulants are added by the critical coagulation density or more. The above-mentioned critical coagulation density is an index related to stability of a water-based dispersion, showing density wherein coagulation occurs when a coagulant is added. The above-mentioned critical coagulation density varies depending upon an emulsified component and a dispersion itself. For example, it is described in "Polymer Chemistry" Volume 17, on page 601 (1960), edited by Japan Polymer Academy" written by Seizo Okamura. By means of it, detailed critical coagulation density can be obtained. Another method is to add a desired salt in an object particle dispersion by changing density, to measure ξ potential of aforesaid dispersion and when ξ potential value is changed the salt density is obtained as the critical coagulation density.

The added amount of coagulating agent used in the present invention may be not less than a critical coagulation density. Preferably, 1.2 time or more and more preferably 1.5 times or more of the critical coagulation density.

A solvent which infinitely dissolves in water means a solvent which infinitely dissolve in a colored polymer dispersion, i.e., a water-based dispersion. The above-mentioned solvent is selected from those which do not dissolve a formed resin in the present invention. Practically, alcohols such as methanol, ethanol, propanol, isopropanol, t-butanol, methoxyethanol and buthoxyethanol, nitriles such as acetonitrile and ethers such as dioxane are cited. Specifically, ethanol, propanol and isopropanol are preferable.

Added amount of solvent used for the above-mentioned infinitely dissolving in water is preferably 1–300 volume % compared to a polymer-containing dispersing solution wherein a coagulant is added.

Various methods can be used as a polymerization method for forming a resin used for the toner of the present invention. However, as a preferable method, the above-mentioned emulsification polymerization method is cited.

As a colorant used in the toner of the present invention, carbon black, a magnetic material, a dye and a pigment ca arbitrarily be used. As carbon black, channel black, furnace black, acetylene black, thermal black and lamp black are used. As a magnetic material, ferromagnetic materials such as iron, nickel, and cobalt and compounds of ferromagnetic metals such as alloy containing the above-mentioned metals, ferrite and magnetite, alloys showing ferromagnetic property by heating though it does not contain ferromagnetic metal, for example, alloys referred to as Heusler's alloy such as manganese-copper-aluminum and manganese-copper-tin and chrome dioxide can be used. As a dye, C.I. Solvent Red 1, 49, 52, 58, 63, 111 and 122, C.I. Solvent Yellow 19, 44, 77, 79, 81, 82, 93, 98, 103, 104, 112 and 162, C.I. Solvent Blue 25, 36, 60, 70, 93 and 95 can be used. Their mixture can also be used. As a pigment, C.I. Pigment Red 5, 48:1, 53:1, 57:1, 122, 139, 144, 149, 166, 177, 178 and 222, C.I. Pigment Orange 31 and 43, C.I. Pigment Yellow 14, 17, 93, 94 and 138, C.I. Pigment Green 7, C.I. Pigment Blue 15:3 and 60 can be used. Their mixture can also be used. It is preferable to disperse the above-mentioned colorant whose the number average primary particle size is generally 10–200 nm to be used.

As for an addition method of the colorant, a method wherein the polymer itself is prepared by an emulsification polymer method, and then, a coagulant is added. The colorant is preferably added at a stage when the monomer is polymerized. When a colorant is added at a stage when a polymer is prepared, it is preferable to use the colorant wherein the surface thereof is processed with a coupling agent in order not to hinder a radical polymerization.

As a dye used in the toner of the present invention, those whose solubility in toluene is not less than 0.01 g/100 ml of toluene can be used. Measurement of solubility of the dye was conducted in accordance with the following method.

At room temperature (25° C.), a dye was added to 100 ml of toluene. The resulting mixture was stirred and left for 24 hours. Following this, the mixture was filtrated. Next, the weight of dye contained in the above-mentioned solution was calculated by removing toluene.

In addition, solubility in water can also be measured similarly.

Dye used in the present invention are concretely as follows.

As for yellow dyes, C.I. Solvent Yellow 2(2.4), 3(3.6), 5(5.7), 7(1.6), 8(2.0), 17(1.0), 24(0.4), 30(3.0), 31(2.0), 35(5.0), 44(0.01), 88(0.8), 89(5.0), 98(2.0), 102(0.7), 103 (1.3), 104(0.11), 105(0.18), 111(0.23), 114(0.09), 162(40.0), and C.I. Disperse Yellow 160(0.02) are cited. As for magenta dyes, C.I. Solvent Red 3(0.7), 14(0.03), 17(1.0), 18(0.8), 22(3.0), 23(1.4), 51(1.4), 53(0.1), 87(0.2), 127(0.3), 128 (1.2), 131(0.2), 145(0.2), 146(1.1), 149(0.19), 150(0.07), 151(0.2), 152(0.89), 153(0.8), 154(0.2), 155(0.05), 156(0.5), 157(0.6), 158(0.9), 176(0.05), 179(0.37) and C.I. Solvent Orange 63(0.02), 68(0.70), 71(0.11), 72(4.9) and 78(0.33) are cited. As for cyan dyes, C.I . Solvent Blue 4(0.5), 8(0.1), 19(0.1), 21(0.1), 22(2.0), 50(1.0), 55(5.0), 63(0.6), 78(0.12), 82(0.4), 83(1.8), 84(2.8), 85(0.2), 86(0.9), 90(0.45), 91(1.0), 92(0.02), 93(0.1), 94(0.12), 95(4.7), 97(12.5) and 104(50) are cited. In the above-mentioned description, numerals enclosed by parenthesis represent solubility in toluene. The dissolvability of the above-mentioned dyes was 1 wt % or less against water. The added amount of the above-mentioned dyes is 1–10 wt % against the resin.

As for an addition method of dye, a method wherein a polymer itself is prepared by emulsion polymerization method, the resulting polymer is colored at a stage where the polymer is coagulated due to addition of the coagulant and a method wherein a colorant is added at a stage where a monomer is polymerized, the resulting mixture was polymerized and colored those methods can be used.

On the other hand, as a black colorant used for full color, regardless of the above-mentioned measurement values, carbon black, magnetic materials, dyes and pigments can arbitrarily be used. As carbon black, channel black, furnace black, acetylene black, thermal black and lamp black are used. As for a magnetic material, ferromagnetic metals such as iron, nickel and cobalt, alloys containing the above-mentioned metals, compounds of ferromagnetic metals such as ferrite and magnetite and alloys showing ferromagnetic property due to heating processing though a ferromagnetic metals are not contained, for example, alloys referred to as Heusler's alloys such as manganese-copper-aluminum and manganese-copper-tin and chromo dioxide can be used.

In addition, low-molecular-weight polypropylene (number average molecular weight was 1500–9000) and a low-molecular-weight polyethylene as a fixing property improving agent may be added, In addition, as a charge control agent, azo-containing metal complexes and quaternary ammonium salts may be added.

From viewpoint of providing fluidity, inorganic fine particles and organic fine particles may be added to colored particles obtained by polymerizing. In this case, it is preferable to use inorganic fine particles. It is also preferable to use inorganic oxide fine particles such as silica, titania and alumina. Furthermore, it is preferable that the above-mentioned inorganic fine particles are subjected to hydrophobicity providing processing by means of a silane coupling agent and a titanium coupling agent.

The toner of the present invention can be manufactured by coagulating plural of the above-mentioned polymers. In such occasions, under stirring the dispersion of polymer particles, adding a metallic salt, which is a coagulant, whose quantity is not less than the critical coagulation density, further adding a solvent which infinitely dissolving in water and heating aforesaid polymer at its glass transition point temperature or higher, thus, the toner can be obtained.

The particle size of the toner of the present invention is arbitrary. However, those having small particle size easily provide the effects of the present invention, and concurrently with this, the degree of the provision of improvement effects is large. In terms of average particle size by volume, 2–10 μm is preferable and 3–9 μm is specifically preferable. The above-mentioned particle size can be controlled by density of a coagulant, added amount of the organic solvent and component of the polymer itself.

With regard to the toner of the present invention, it can be favorably used as a one-component magnetic toner wherein a magnetic material is incorporated, also as a two-component developer wherein it is mixed with a so-called carrier and as an independent non-magnetic toner. In the present invention, it is preferable to use it as a two-component developer wherein it is mixed with the carrier.

As a carrier constituting the two-component developer, both of a non-coated carrier constituted only of magnetic material particles such as iron and ferrite and a resin-coated carrier wherein the surface of the magnetic material particles is coated with a resin. The average particle size of the above-mentioned carrier is 30–150 μm in terms of volume average particle size. In addition, the kind of resin used for coating is not specifically limited. However, for example, a styrene-acrylic acid (methacrylic acid) and ester resin are cited.

(2) Constitution of the image forming method

In the toner of the present invention, a development method is not specifically limited. It can be used in a contact development system or non-contact development system. In the contact system development, the layer thickness of developer having the toner of the present invention is ordinarily 0.1–8 mm and preferably 0.4–5 mm in development region. In addition, in this occasion, gap between the photoreceptor and the developer carrier is ordinarily 0.15–7 mm and preferably 0.2–4 mm.

In the non-contact development system, a developer layer formed on a developer carrier and the photoreceptor is not contacted. In order to constitute the above-mentioned development system, it is preferable that the developer layer is formed with a thin layer. This development system forms a 20–500 μm thickness developer layer at development region on the surface of the developer carrier, wherein gap between the photoreceptor and the developer carrier is larger than aforesaid developer layer.

Since the toner of the present invention has high charge rising property, it is specifically useful for the non-contact development method. Namely, since change in terms of development electrical field is wide in the non-contact development method, minute charge change noticeably influences on development itself. Accordingly, due to the change of the minute toner charge amount, fluctuation of developability such as image quality and density become large. However, in the case of the toner of the present invention, charge rising property is so high that charge change is small and thereby stable charge amount can be kept. Therefore, even in the case of the non-contact development method, stable image can be formed for a long time.

In the non-contact development method, a thin layer is formed by pressing a magnetic blade which uses magnetic force or a developer layer controlling bar on the surface of a developer carrier. In addition, a method to control the developer layer by bringing an urethane blade or phosphorus bronze plate into contact with the surface of a developer carrier can also be used. As pressure force by the pressure control member, 1–15 gf/mm is preferable. When the pressure force is small, the control force becomes insufficient. Therefore, conveyance become unstable. On the other hand, when the pressure force is large, stress on the developer becomes too great so that durability of the developer is easily reduced. Preferable range is 3–10 gf/mm. In addition, in the non-contact development method, when development bias is provided when developing, a method only to provide direct current component may be used. In addition, a method to apply A.C. bias may also be used.

The size of developer carrier is preferably 10–40 mmϕ in terms of diameter. When the diameter is smaller than this, mixture of developers becomes insufficient so that it is difficult to keep sufficient mixture for providing sufficient charge provision to toner. When the diameter is larger than this, centrifugal force on the developer become too large, tending to cause toner flying.

Hereinafter, one example of non-contact development system will now be explained by using FIG. 1.

FIG. 1 shows a schematic drawing of a developing section of the non-contact development system preferably usable for the image forming system of the present invention. Numeral 1 represents a photoreceptor, 2 represents a developer carrier, 3 represents a two-component developer containing the toner of the present invention, 4 represents a developer layer regulating member, 5 represents development region, 6 represents a developer layer and 7 represents power supply for forming an alternative electrical field.

The two-component developer containing the toner of the present invention is carried by magnetic force on developer carrier 2 having a magnet 2B therein, and conveyed to development region 5 due to shift of development sleeve 2A. When conveying, the thickness of developer layer 6 is regulated by developer layer regulating member 4 in development region 5 so that it does not contact photoreceptor 1.

The minimum gap (Dsd) in development region 5 is larger than the thickness of developer layer 6 conveyed to aforesaid region (preferably 20–50 μm). For example, 100–1000 μm. Power supply for forming an alternating electrical field is preferably A.C. whose frequency is 1–10 kHz and voltage is 1–2 kvp-p. Power supply 7 may have a constitution wherein direct current Is added to A.C. in series. As the D.C. voltage, 300–800V is preferable.

Figure 2:
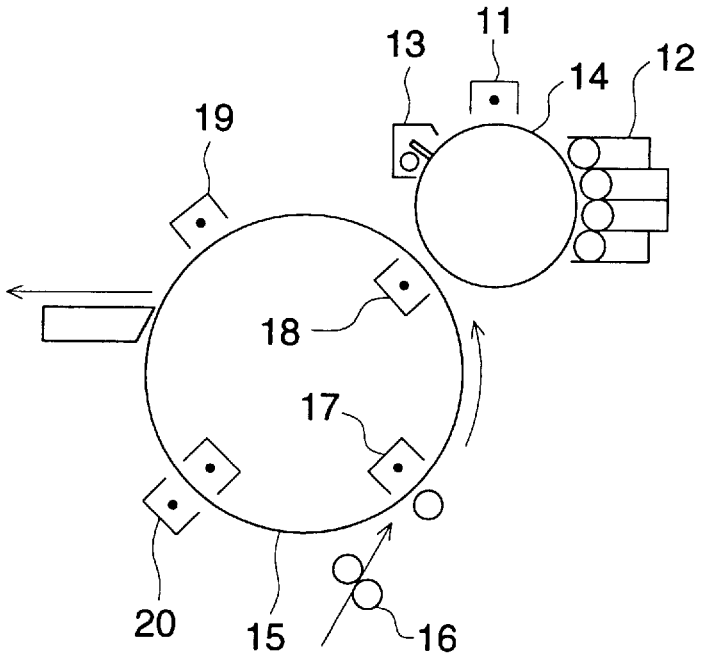
FIG. 2 is a schematic view showing one example of a serial transfer system.
Figure 3:
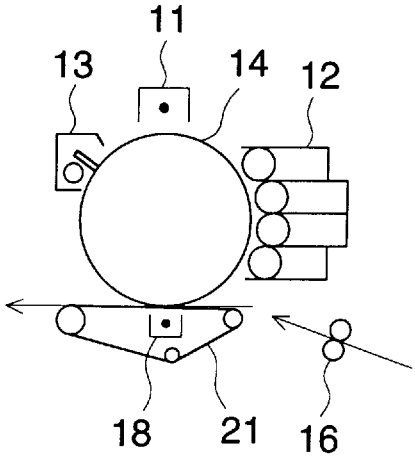
FIG. 3 is a schematic view showing one example of a simultaneous transfer system.

When the toner of the present invention is applied to the color image forming system, a system to serially transfer toner onto an image support while forming a mono color image onto a photoreceptor (this system is referred to as a serial transfer system, shown in FIG. 2) and a system to simultaneously transfer toner onto the image support after developing a mono color image onto the photoreceptor for plural times for forming a color image (this system is referred to as a simultaneous transfer system, shown in FIG. 3) are cited.

Image forming methods shown in FIGS. 2 and 3 will now be explained in detail.

As shown in FIGS. 1, 2 and 3, as a developer carrier used in the present invention, a developing device wherein magnet 2B is housed inside he carrier. As sleeve 2A constituting the surface of the developer carrier, aluminum, aluminum whose surface was oxidizing processing and stainless steel are used.

Hereinafter, one example of a serial transfer system shown in FIG. 2 will now be shown.

Numeral 11 represents a charging device, 12 represents developing unit composed of developing devices in which a yellow, magenta, cyan and black toners are respectively loaded. Four devices are correspondent to 4 colors respectively. The basic constitution of the above-mentioned developing devices are the same as that of the schematic view of the developing section in FIG. 1. Numeral 14 represents a photoreceptor, 13 represents a cleaning unit, 15 represents a transfer drum temporally maintaining a single color formed on the photoreceptor drum, maintaining the next signal color toner image thereon and forming a desired multi-color image finally. 16 represents a conveyance unit transferring a recording medium wherein an toner image on the transfer drum is transferred. 17 represents an absorption electrode, located inside of transfer drum 15, which conducts corona discharge from inside the photoreceptor and which electrostatically the recording material on aforesaid drum. 18 represents a transfer electrode which transfers the toner image formed on photoreceptor 14 serially on the transfer drum, 19 represents a peeling electrode used for peeling the recording medium statically absorbed on transfer drum 15 and 20 represents a removing electrode which removes charge remaining on the transfer drum after the recording medium was peeled off.

By means of charge electrode 11, a uniform charge was formed on photoreceptor drum 14. Following this, the charge was subjected to imagewise exposure (not illustrated) so that an electrostatic latent image was formed. This electrostatic latent image was developed by a developing device keeping one color toner (for example, black toner) in development unit 12 so that one color toner image is formed on photoreceptor 14. On the other hand, a recording medium conveyed onto transfer drum 15 by conveyance unit 16 is electrostatically absorbed on the transfer drum by absorption electrode 17, and then conveyed to the transfer section.

The above-mentioned toner image formed on photoreceptor drum 14 is transferred onto the conveyed recording medium in the transfer section. On photoreceptor drum 14 wherein the above-mentioned transfer image was transferred, toner remains. This residual toner is removed by cleaning unit 13, and then, used in the next process. When a multi-color image is formed, toner images of other colors are formed by developing in accordance with similar process. Serially, they are transferred on serial transfer drum 15. Finally, a desired toner image Is formed on a recording medium absorbed on transfer drum 15. The recording medium wherein a desired toner image is formed is peeled by peeling electrode 19, and then, conveyed to the fixing section. Thus, the finally fixed multi-color toner image is obtained. On the other hand, charge remaining on transfer drum 15 is removed by removing electrode 20, and then, used in the next process.

Next, referring to FIG. 3, a simultaneous transfer system will now be explained.

Each section in the apparatus is omitted, since they are identical to FIG. 2. Incidentally, numeral 21 is a conveyance section wherein a toner image is transferred while conveying a recording medium conveyed thereto. Uniform charge is formed by means of the charge electrode on photoreceptor drum 14. Following this, electrostatic latent image is formed by a latent image forming means (this means is not illustrated). This electrostatic latent image is developed by a developing device having one color toner (for example, a black toner) in developing unit 12 so that one color toner image is formed on the photoreceptor drum. In the present illustration example, this toner image forms uniform charge and electrostatic latent image on the photoreceptor having toner image again while aforesaid toner image is not transferred by charging electrode 11. Next, it is developed by a developing device having toner whose color is different from above. Toner image having another color is superposed on the previous toner image to be formed. Meanwhile, cleaning unit 13, transfer electrode 18 and conveyance section 21 are not operated. Concurrently with this, they are escaped from photoreceptor drum 14 in such a manner that the toner image on photoreceptor 14 is not disturbed.

After a desired image is formed so that a multi-color toner image is formed, toner image is transferred by transfer electrode 18 while aforesaid toner image is conveyed to the recording medium conveyed by conveyance unit 16 in conveyance section 21. The recording medium carrying the transferred toner image is conveyed to the fixing section and fixed so that a final multi-color toner image is formed on the recording medium. Toner remains on photoreceptor drum 14 after the toner image was transferred. Therefore, it is removed by cleaning unit 13, and used in the next process.

The toner image formed on the photoreceptor by each system described as above is transferred onto the recording medium such s paper by means of a transfer process. The transfer system is not specifically limited. Various systems such as a so-called corona transfer system and the roller transfer system can be employed.

Since the toner of the present invention has a high transfer efficiency and little toner remaining on the photoreceptor, when it is used in a blade cleaning system, pressure force of a blade onto the photoreceptor can be lightened. Accordingly, it can contribute to lengthening life of the photoreceptor.

The toner remained on the photoreceptor after the toner image was transferred onto the recording medium is removed due to cleaning, and repeatedly used in the next process.

Cleaning mechanism in the present invention is not specifically limited. Conventional cleaning mechanism such as a blade cleaning system, a magnetic brush cleaning system and a fur brush cleaning system can arbitrarily be used. From viewpoint of reasons described above, among the above-mentioned cleaning mechanism, a blade cleaning system using a so-called cleaning blade can be preferably used.

Hereinafter, a heat fixing method preferably used in the present invention will now be explained.

Preferable heat-fixing methods used in the present invention include: (1) a heat roller fixing method and (2) a fixing method wherein toner images are heated and fixed on a recording material by the use of a heating material fixedly mounted and a pressure member which faces aforesaid heating material to be in pressure contact therewith and rotates to bring the recording material to be in pressure contact with the heating material through a film member.

The former heat roller fixing method described in (1) above will now be explained referring to FIG. 6. There is provided upper roller 100 having heating source 400 inside metallic cylinder 300, which is constituted by iron or aluminum, whose surface 200 is covered with tetrafluoroethylene or a polytetrafluoroethylene-perfluoroalkoxy vinyl ether copolymer, and there is also provided lower roller 500 made of silicone rubber. Specifically, upper roller 1 has a line heater as heating source 400 so that the temperature of the surface of upper roller 100 is heated to about 110° to 220° C.

Between this upper roller 100 and lower roller 500, recording member 600 which carries toner image 700 is passed through so that toner image 700 is heat-fixed onto recording member 600. In accordance with a conventional heat roller fixing method, a part of fused toner is adhered on upper roller 100. After one rotation, so-called offset phenomenon, i.e., the toner adhered on upper roller 100 is stacked to another part, occurs. In an extreme case, toner melted on upper roller 100 creates so-called rolling phenomenon wherein the toner is rolled on upper roller 100 together with a recording medium while not separating from a recording medium, and concurrently with this, the surface of fixing roller is contaminated. At the fixing unit, pressure is provided between upper roller 1 and lower roller 500 so that lower roller 500 is deformed. Accordingly, the so-called "nip" is formed. The nip width is ordinarily 1 to 10 mm, and preferably 1.5 to 7 mm. Fixing speed is preferably 40 to 4000 mm/sec. When the nip width is too small, heat cannot be provided to toner uniformly, resulting in the occurrence of uneven fixing. To the contrary, when the nip width is too large, fusion of toner is promoted so that fixing off-set easily occurs.

In the heat roller fixing method of the present invention, a fluorine-containing silicone oil layer of the present invention is formed on the surface 200 of upper roller 100. Due to inter-effect of the above-mentioned layer and the present invention, objects of the present invention are effectively attained. The fluorine-containing silicone oil layer of the present invention formed on the surface 200 of upper roller 100 is formed as follows.

Namely, on the longitudinal surface 200 of upper roller 100, impregnated roller 800 is brought into contact with, and is rotated in an arrowed direction. In the above-mentioned impregnated roller 800, a fluorine-containing silicone oil of the present invention is impregnated. When fixing is conducted, in accordance with rotation of upper roller 100, the fluorine-containing silicone oil is fed from impregnated roller 800 onto the surface of upper roller 100 by minute by minute. As a result, on surface 200 of upper roller 100, the fluorine-containing silicone oil layer of the present invention is formed.

The latter fixing method (2) will now be explained referring to FIG. 7.

Numeral 15 is a line-shaped heating material, with low heat capacity, which is fixed and supported on an apparatus. Electric current is passed at both ends of line-shaped heating material 150 wherein an electric resistance material is coated at thickness of 1.0 to 2.5 mm on alumina board 170 whose thickness is 0.2 to 5.0 mm and preferably 0.5 to 3.0 mm, the width is 10 to 15 mm and the length is 240 to 400 mm. An electric current of DC 100V is flowed through the line-shaped heating materials 15 in the form of a pulse of 25 msec. in frequency in such a manner that the pulse width is modulated in accordance with a required amount of energy on the basis of the temperature measured by temperature sensor 160. Provided that temperature, sensed at line-shaped heating material 15 with low heat capacity, by means of temperature sensor 160 is T1, surface temperature T2 of the film member 140 which faces the resistance material is lower than T1. Here, T1 is preferably 110° to 220° C. The temperature of T2 is preferably lower than that of T1 by 0.5 to 10° C. Surface temperature T3 of film member 140 at a point where film member is peeled off from the surface of fixed toner is almost equivalent to T2. In the above-mentioned manner, film member, after being brought into contact with the heated material whose energy and temperature are controlled, moves toward the same direction as the recording member. The above-mentioned film member 140 is a heat-durable film (preferably an endless film) whose thickness is 10 to 35 $\mu$m, made of polyester, polyperfluoroalkoxyvinyl ether, polyimide and polyether imide, covered with a releasing agent layer, whose thickness is 5 to 15 $\mu$m, wherein a conductive member is added to a fluorine resin such as Teflon. Ordinarily, film member 140, whose total thickness is 10 to 100 $\mu$m, is conveyed toward the arrowed direction due to the driving and tension by means of driving roller 110 and driven roller 120 without wrinkle or crumpling. The fixing speed is preferably 40 to 400 mm/sec. The pressure roller 130 has an elastic rubber layer having high releasing property such as silicone rubber. It provides a total pressure of 2 to 30 kg to low heat volume line-shaped heating material 150 through film member 140. The above-mentioned pressure member rotates in the arrowed direction while pressing the line heated material. By passing the recording member, which carries the toner image between the above-mentioned film member 140 and pressure roller 130, the toner image is caused to be molten-fixed onto the recording member.

Figure 6:
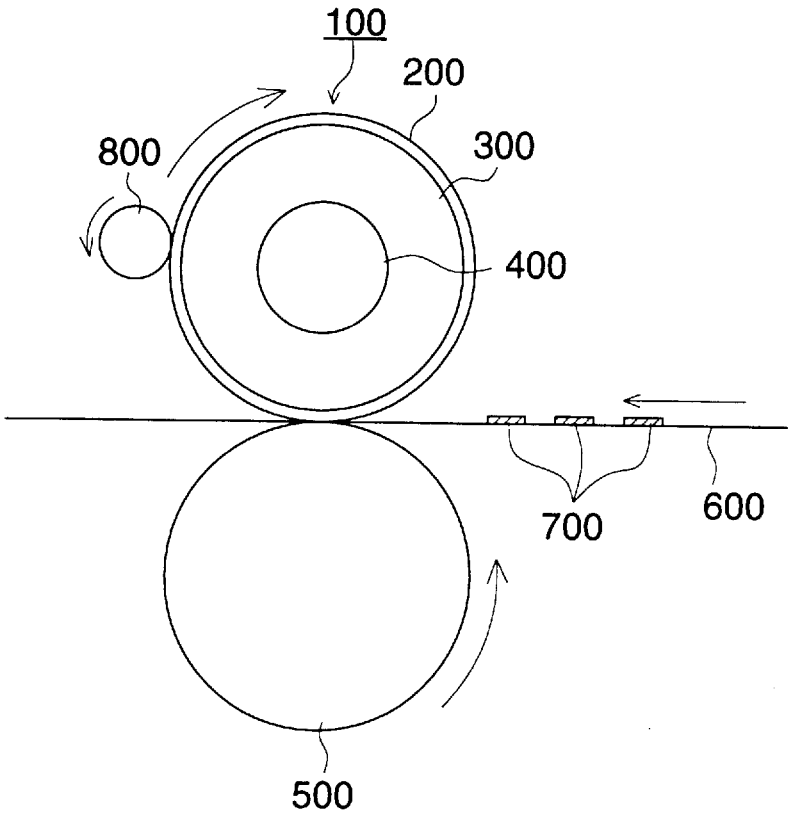
FIG. 6 is a drawing showing a schematic block diagram of a heat roller fixing method.
Figure 7:
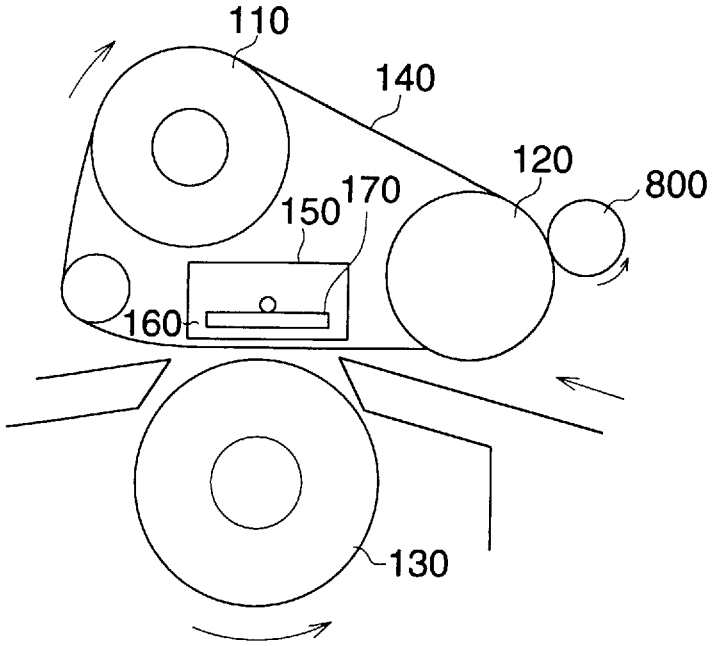
FIG. 7 is a drawing showing a schematic block diagram of a heat fixing method wherein a heating material is brought into contact with a recording material through a film material.

In FIG. 7 as is same manner as in FIG. 6, impregnated roller 800 is brought into contact with, and is rotated in an arrowed direction. In the above-mentioned impregnated roller 800, a fluorine-containing silicone oil of the present invention is impregnated. When fixing is conducted, in accordance with rotation of upper roller 100, the fluorine-containing silicone oil is fed from impregnated roller 800 onto the surface of upper roller 100 by minute by minute. As a result, on surface 200 of upper roller 100, the fluorine-containing silicone oil layer of the present invention is formed.

Another example of the fixing method described in (2) above will now be explained referring to FIG. 8.

Figure 8:
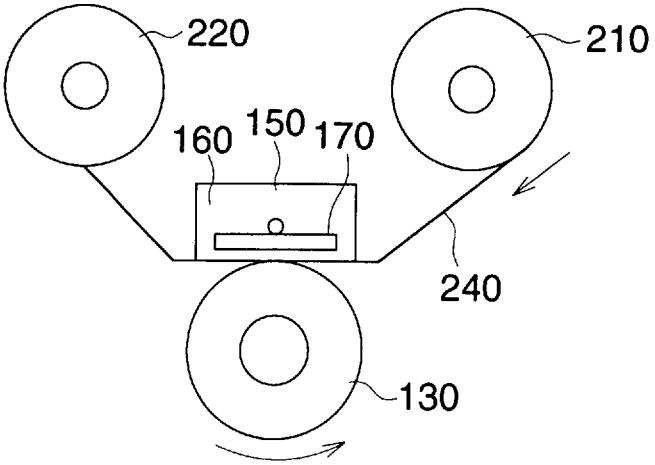
FIG. 8 is a drawing showing a schematic block diagram of a modified example.

FIG. 8 employs an end-having film material, while FIG. 7 employs an endless film.

Namely, as shown in FIG. 7, an end-having film 240 is rolled on sheet feeding shaft 210 and winding shaft 220. Every time fixing is conducted, film material 240 is moved to an arrowed direction. In this occasion, the film is driven by means of winding shaft 220. Numerals 130, 150, 160 and 170 are respectively identical to those in FIG. 7.

Figure 4:
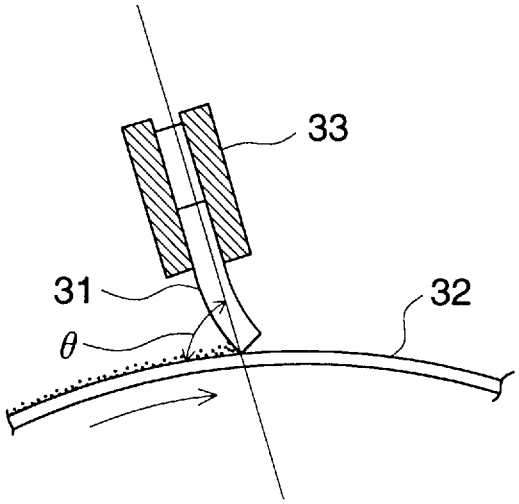
FIGS. 4 and 5 are schematic views showing one example of a blade cleaning system.
Figure 5:
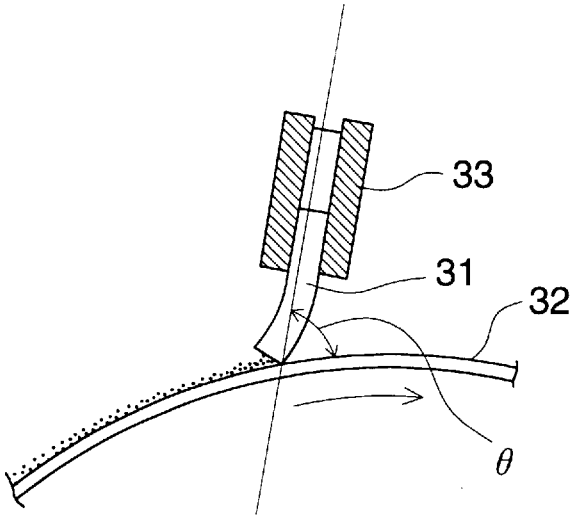

As the above-mentioned constitution, any one constitution described in either FIGS. 4 and 5. FIGS. 4 and 5 are constitution wherein cleaning blade 31 is hold by holder 33. Numeral 32 is a photoreceptor. Rotation direction of photoreceptor 32 is shown by an arrow. θ is an angle formed by holder 33 and photoreceptor 32. In both of FIGS. 4 and 5, it is preferably 10°–90°, and preferably 15°–75° C. As a material for constituting cleaning blade 31, elastic materials such as silicone rubber and urethane rubber can be used. In this occasion, those having rubber hardness of 30°–90° is preferable. Thickness of cleaning blade is preferably 1.5–5 mm, and that of outer length of the holder is preferably 5–20 mm and pressure force on the photoreceptor is preferably 5–50 gf/cm.

Hereinafter, effects of the present invention will practically be explained.

Example 1

Manufacturing example 1 of colored particles

To a solution wherein 4.92 g of sodium dodecylsulfate was dissolved in 120 ml of pure water, 10.67 g of carbon black (Legal 330R: produced by Cabbot Inc.) processed with an aluminum coupling agent (Plain Act Al-M: produced by Ajinomoto). Ultrasonic wave was applied to the mixture while stirring. Thus, an aqueous dispersion of carbon black was prepared. In addition, an emulsified dispersion, in which solid density of 20 wt %, wherein low-molecular-weight polypropylene (the number average molecular weight was 3200) was emulsified by in water by a surfactant while adding heat was prepared. To the dispersion of the above-mentioned carbon black, 43 g of low-molecular-weight polypropylene emulsified dispersion was mixed. Then, to the mixture, 98.1 g of styrene monomer, 18.4 g of n-butyl acrylate monomer, 6.1 g of methacrylic acid monomer, 3.3 g of t-dodecylmercaptane and 850 ml of pure water subjected to degassing were added. Following this, while the resulting mixture was stirred under nitrogen gas flow, the temperature was raised to 70° C. Next, to the mixture, 200 ml of pure water subjected to degassing wherein 4.1 g of potassium persulfate was dissolved was added. The resulting mixture was reacted at 70° C. for 6 hours. The resulting carbon black containing colored particle dispersion is "dispersion 1". Incidentally, the primary particle size and molecular weight were measured (for the primary size, a light scattering electrophoresis particle size analyzer ELS-800, produced by Otsuka Electron Ind. Co., and molecular weight distribution was calculated in terms of styrene by using GPC). Table 1 shows the results thereof.

To 600 ml of the above-mentioned dispersion 1, 160 ml of a 2.7 mol/liter aqueous potassium chloride solution was added. In addition, to the mixture, 94 ml of isopropyl alcohol and 40 ml of pure water wherein 5.4 g of polyoxyethyleneoctylphenyl ether (the average polymerization degree of ethyleneoxide was 10) was dissolved were added. Following this, the temperature of the resulting mixture was raised to 85° C., and then, reacted for 6 hours. After completion of reaction, the reacted solution was filtrated, subjected to washing and dried. Thus, a colored particles of the present invention was obtained. This is a colored particle 1.

Manufacturing example 2 of colored particles

In the same manner as in Manufacturing example 1 of colored particle except that C.I. Pigment Blue 15:3 was used in stead of carbon black whose surface was processed, a colored particle of the present invention was obtained. Incidentally, the resulting dispersion was defined to be "Dispersion 2" and the resulting colored particle was defined to be "colored particle 2".

Manufacturing example 3 of colored particles

In the same manner as in Manufacturing example 1 of colored particle except that C.I. Pigment Red 122 was used in stead of carbon black whose surface was processed, a colored particle of the present invention was obtained. Incidentally, the resulting dispersion was defined to be "Dispersion 3" and the resulting colored particle was defined to be "colored particle 3".

Manufacturing example 4 of colored particles

In the same manner as in Manufacturing example 1 of colored particle except that C.I. Pigment Yellow 17 was used in place of carbon black whose surface was processed, a colored particle of the present invention was obtained. Incidentally, the resulting dispersion was defined to be "Dispersion 4" and the resulting colored particle was defined to be "colored particle 4".

Manufacturing example 5 of colored particles

In the same manner as in Manufacturing example 1 of colored particle except that "dispersion 1" was used and the added amount of isopropyl alcohol was 150 ml, a colored particle of the present invention was obtained. The resulting colored particle was defined to be "colored particle 5".

Manufacturing example 6 of colored particles

In the same manner as in Manufacturing example 2 of colored particle except that "dispersion 2" was used and the added amount of 2.7 mol/l of potassium chloride was 250 ml, a colored particle of the present invention was obtained. The resulting colored particle was defined to be "colored particle 6".

Manufacturing example 7 of colored particles

In the same manner as in Manufacturing example 3 of colored particle except that "dispersion 3" was used and the added amount of isopropyl alcohol was 68 ml, and that of 2.7 mol/l of potassium chloride was 200 ml, a colored particle of the present invention was obtained. The resulting colored particle was defined to be "colored particle 7".

Manufacturing example 8 of colored particles

In the same manner as in Manufacturing example 4 of colored particle except that "dispersion 4" was used and the added amount of isopropyl alcohol was 72 ml and that of 2.7 mol/l of potassium chloride was 200 ml, a colored particle of the present invention was obtained. The resulting colored particle was defined to be "colored particle 8".

TABLE 1

| Sample | Number average primary particle size | Weight average molecular weight (Mw) | Number average molecular weight (Mn) | Mw/Mn |
|---|---|---|---|---|
| Dispersion 1 | 0.18 μm | $2.07 \times 10^4$ | $9.50 \times 10^3$ | 2.18 |
| Dispersion 2 | 0.25 μm | $1.85 \times 10^4$ | $8.81 \times 10^3$ | 2.10 |
| Dispersion 3 | 0.32 μm | $1.66 \times 10^4$ | $7.23 \times 10^3$ | 2.30 |
| Dispersion 4 | 0.48 μm | $1.98 \times 10^4$ | $8.79 \times 10^3$ | 2.26 |

Producing 1 of comparative colored particles

To 100 parts of styrene-n-butyl acrylate copolymer (copolymerization ratio is 85:15, weight average molecular weight=63,000), 10 parts of carbon black and 5 parts of low-molecular-weight polypropylene (number average molecular weight=3,200) were added. The mixture was subjected to kneading, crushing and classifying so that a comparative colored particle was obtained. This is defined to be comparative colored particle 1.

Producing 2 of comparative colored particles

A colored particle for comparative was obtained in the same manner as in Production example 1 of colored particle for comparative except that C.I. Pigment Blue 15:3 was used in stead of carbon black. This is defined to be comparative colored particle 2.

Producing 3 of comparative colored particles

A comparative colored particle was obtained in the same manner as in Production example 1 of comparative colored particle except that C.I. Pigment Red 122 was used in stead of carbon black. This is defined to be colored particle 3 for comparative.

Producing 4 of comparative colored particle

A colored particle for comparative was obtained in the same manner as in Production example 1 of comparative colored particle except that C.I. Pigment Yellow 17 was used in place of carbon black. This is defined to be comparative colored particle 4.

Manufacturing example of toners

To the above-mentioned colored particles 1–8 and comparative colored particle 1–4, 1 weight % of hydrophobic silica (the primary average particle size by number=12 nm) is added respectively to obtain toners. These are toners 1–8 and comparative toners 1–4.

Evaluation

Each of physical properties of the above-mentioned dispersion 1–4, colored particles 1–8, comparative colored particles 1–4, toners 1–8 and comparative toners 1–4. Incidentally, 2SD in the following table was measured by the use of a Particle Size Distribution Analyzer SALD-1100 (produced by Shimadzu Seisakusho).

TABLE 2

(Colored particles)

| Sample | Volume average particle size | BET value | 2 SD |
|---|---|---|---|
| Colored particle 1 | 5.60 μm | 22.1 | 2.6 |
| Colored particle 2 | 5.32 μm | 20.4 | 2.4 |
| Colored particle 3 | 5.21 μm | 24.6 | 2.7 |
| Colored particle 4 | 5.56 μm | 28.7 | 2.1 |
| Colored particle 5 | 6.23 μm | 10.8 | 2.1 |
| Colored particle 6 | 8.44 μm | 18.9 | 2.0 |
| Colored particle 7 | 5.73 μm | 37.9 | 1.8 |
| Colored particle 8 | 5.80 μm | 29.1 | 2.1 |
| Comparative colored particle 1 | 5.91 μm | 3.21 | 7.1 |
| Comparative colored particle 2 | 6.01 μm | 3.29 | 7.0 |
| Comparative colored particle 3 | 5.82 μm | 3.93 | 7.2 |
| Comparative colored particle 4 | 5.92 μm | 4.12 | 7.1 |

TABLE 3

| Sample | Volume average particle size | BET value | 2 SD |
|---|---|---|---|
| Toner 1 | 5.60 μm | 21.9 | 2.6 |
| Toner 2 | 5.32 μm | 21.8 | 2.4 |
| Toner 3 | 5.21 μm | 23.7 | 2.7 |
| Toner 4 | 5.56 μm | 28.4 | 2.1 |
| Toner 5 | 6.23 μm | 14.9 | 2.1 |
| Toner 6 | 8.44 μm | 19.1 | 2.0 |
| Toner 7 | 5.73 μm | 33.7 | 1.8 |
| Toner 8 | 5.80 μm | 28.5 | 2.1 |
| Comparative toner 1 | 5.91 μm | 3.41 | 7.1 |
| Comparative toner 2 | 6.01 μm | 3.51 | 7.0 |
| Comparative toner 3 | 5.82 μm | 4.01 | 7.2 |
| Comparative toner 4 | 5.92 μm | 3.69 | 7.1 |

Incidentally, for evaluation, the above-mentioned toner was mixed with a ferrite carrier having a volume average particle size of 50 μm coated with a styrene-acrylic resin, a developer having a toner density of 7 wt % was prepared and employed. In addition, developers respectively corresponding to the above-mentioned toners 1–8 and comparative toner 1–4 are defined to be developers 1–8 and comparative developer 1–4.

(Evaluation in accordance with the contact developing system) Evaluation was conducted by using a copying machine U-Bix 3135 (produced by Konica Corporation). Incidentally, layer thickness of a developer was 1.5 mm, and gap (Dsd) between the photoreceptor and the developer carrier was 0.5 mm.

Incidentally, the cleaning device has a constitution shown in FIG. 5, wherein an angle θ formed by holder 33 and photoreceptor 32 is 22°. As a material constituting cleaning blade 31, urethane rubber was used. Rubber hardness of urethane rubber was 65°, its thickness was 2 mm and the length of the holder outside was 8 mm. In addition, pressure force on photoreceptor was 15 gf/cm.

Evaluation was conducted under the condition of low temperature and low humidity (10° C./10%RH), in which, after continuously printing 10,000 sheets, the copied papers are left alone for 24 hours and then copying is re-started. Copying was conducted up to 60,000 sheets. Fogging density occurring at the first image after the pose was measured. The following Table 4 shows the results thereof.

Incidentally, fogging density was measured by a relative density when the density of paper was defined to be 0, and measured by a Macbeth densitometer (RD-918). For evaluation, "developer 1", "developer 4", "developer 5" and comparative "developer 1" were used.

TABLE 4

| Developer No. | Starting | After 10,000 sheets | After 20,000 sheets | After 30,000 sheets | After 40,000 sheets | After 50,000 sheets | After 60,000 sheets |
|---|---|---|---|---|---|---|---|
| Developer 1 | 0.00 | 0.001 | 0.001 | 0.001 | 0.001 | 0.002 | 0.002 |
| Developer 4 | 0.00 | 0.001 | 0.001 | 0.001 | 0.001 | 0.002 | 0.002 |
| Developer 5 | 0.00 | 0.001 | 0.001 | 0.001 | 0.001 | 0.002 | 0.002 |
| Comparative developer 1 | 0.00 | 0.002 | 0.003 | 0.004 | 0.006 | 0.009 | 0.012 |

From the results shown in table 4, any of developers of the present invention result in little occurrence of fogging after a large number of copying, showing stable copying condition.

(Evaluation in the non-contact developing system)

The non-contact developing system was shown in FIG. 1. By adopting this developing system and by the use of a color copying machine U-Bix 9028 (produced by Konica Corporation) wherein it was modified as shown in FIG. 3 in the case of a simultaneous transfer system and as shown in FIG. 2 in the case of the simultaneous transfer system. In both cases, image processing was conducted under the following conditions.

Incidentally, for a photoreceptor, a minus charging type photoreceptor was used. As for an exposure light source, a semiconductor laser was used and reversal developing was conducted.

Surface potential on the photoreceptor: −550V

DC bias: −250V

AC bias: Vp-p: −50 to −450V

Alternating electrical field frequency: 1800 Hz

Dsd: 300 pm

Pressure regulating force: 10 gf/mm

Pressure regulating bar: SUS416 (produced of magnetic stainless)/diameter of 3 mm Developer thickness: 150 μm Development sleeve: 20 mm With regard to the developer, :developer 1" through "developer 4", "developer 5" through "developer 8" and "comparative developer 1" through "comparative developer 4" were combined to be used as a color developer. As an evaluation method, a full color image whose pixel ratio was 75% was used, and printed under the condition of high temperature and high humidity (33° C./80%RH). Printing was continuously conducted for 10,000 sheets, and then, the copied sheets were left alone for 24 hours and then, next printing was conducted. The number of sheet in which transfer unevenness occured was recorded.

The following Tables 5 and 6 show the evaluation results.

TABLE 5

(The serial transfer method)

| Developer | Number of sheet wherein transfer unevenness occurs |
|---|---|
| Developers 1–4 | No unevenness occurred |
| Developers 5–8 | No unevenness occurred |
| Comparative developers 1–4 | Unevenness occurred at 4000th sheet. |

TABLE 6

(The simultaneous transfer method)

| Developer | Number of sheet wherein transfer unevenness occurs |
|---|---|
| Developers 1–4 | No unevenness occurred |
| Developers 5–8 | No unevenness occurred |
| Comparative developers 1–4 | Unevenness occurred at 4000th sheet. |

From the results of Tables 5 and 6, when the developers of the present invention are used, no transfer unevenness occurs in the case of the serial transfer method nor the simultaneous transfer method, resulting in excellent results.

Example 2

<Manufacturing examples of developers>

To a solution wherein 4.92 g of sodium dodecyl sulfate was dissolved in 120 ml of pure water, 10.67 g of the following colorants were added. By applying ultrasonic wave while stirring, aqueous dispersions of colorants were prepared.

To a solution wherein 4.92 g of sodium dodecylsulfate was dissolved in 120 ml of pure water, each 10.67 g of the following colorants was added and then, ultrasonic wave was applied to the mixture while stirring. Thus, each aqueous dispersion of the following colorants was prepared.

Used colorants

Yellow toner: C.I. Pigment Yellow 17

Magenta toner: C.I. Pigment Red 122

Cyan toner: Pigment Blue 15:3

Black toner: Carbon black processed with an aluminum coupling material

Then, to each dispersions, 98.1 g of styrene monomer, 18.4 g of n-butyl acrylate monomer, 6.1 g of methacrylic acid monomer, 3.3 g of t-dodecylmercaptane and 850 ml of pure water subjected to degassing were added. Following this, while the resulting mixture was stirred under nitrogen gas flow, the temperature was raised to 70° C. Next, to the mixture, 200 ml of pure water subjected to degas wherein 4.1 g of potassium persulfate was dissolved was added. The resulting mixture was reacted at 70° C. for 6 hours.

To each of 600 ml of dispersions, 160 ml of a 2.7 mol/liter aqueous potassium chloride, 94 ml of isopropyl alcohol and 40 ml of pure water wherein 5.4 g of polyoxyethylene octylphenyl ether (its average polymerization degree of ethylene oxide was 10) were added. Following this, the temperature of the resulting mixtures was raised to 85° C. and they were reacted for 6 hours. After completion of reaction, the reacted solution was filtrated, washed and dried so that colored particles were obtained. To these, 1.0 part of hydrophobic silica was added to obtain toners 1–5.

In addition, 43 g of an emulsified dispersion having solid density of 20 wt %, wherein low-molecular-weight polypropylene (the number average molecular weight of 3,200) was emulsified in water by a surfactant while heating, was added to each of the above-mentioned dispersions. Reaction was conducted in accordance with mentioned above, and hydrophobic silica was similarly added to obtain toner. This is defined to be toner 7.

By the use of a dispersion having solid density of 20 wt %, wherein a modified polypropylene having a carboxyl group, an acid value of 22, the weight average molecular weight of 12000 and the dispersion size of 190 nm, was dispersed similarly as above, to obtain toner. This is defined to be toner 8.

Incidentally, the volume average particle size of each toner was regulated to 5.2 μm (using SALD-1100, produced by Shimadzu Seisakusho). The weight average molecular weight, number average molecular weight, molecular weight distribution and BET specific surface area of the resulting colored particles were measured under the following conditions.

Incidentally, in the above-mentioned reaction, by varying reaction temperature and added amount of polymerization initiator, those having various molecular weight were prepared. Toner 6 was obtained by using a colored particle due to kneading with a resin having a molecular weight distribution shown in Table 1, crushing and classifying. (Weight average molecular weight, number average molecular weight and molecular weight distribution)

Instrument: Toso-HLC-8020

Column: GMHXL×2, G2000HXL×1

Sensor: RI

Flow rate of an eluent: 1.0 ml/min.

Density of sample: 0.01 g/20 ml

Quantity of sample: 100 μl

Calibration curve: prepared by means of a standard polystyrene (The BET specific surface area)

The BET specific surface area was measured by using a Flow Sorb II2300, produced by Shimadzu under flowing a nitrogen gas.

The following Table 7 shows the results thereof.

TABLE 7

| Toner No. | Developer | Mw ($10^4$) | Mn ($10^3$) | Mw/Mn | BET value | Volume average particle size (μm) | 2SD | Remarks |
|---|---|---|---|---|---|---|---|---|
| Yellow 1 | Developer 1 | 1.67 | 3.7 | 4.5 | 32.1 | 5.2 | 2.7 | |
| Magenta 1 | | 1.65 | 3.9 | 4.2 | 30.2 | 5.2 | 2.7 | Inv. |
| Cyan 1 | | 1.63 | 3.9 | 4.2 | 31.1 | 5.2 | 2.4 | |
| Black 1 | | 1.65 | 4.0 | 4.1 | 33.1 | 5.2 | 2.6 | |
| Yellow 2 | Developer 2 | 2.56 | 7.3 | 3.5 | 25.9 | 5.2 | 2.5 | |

TABLE 7-continued

| Toner No. | Developer | Mw ($10^4$) | Mn ($10^3$) | Mw/Mn | BET value | Volume average particle size ($\mu$m) | 2SD | Remarks |
|---|---|---|---|---|---|---|---|---|
| Magenta 2 | | 2.35 | 7.3 | 3.2 | 24.9 | 5.2 | 2.4 | Inv. |
| Cyan 2 | | 2.63 | 8.0 | 3.3 | 23.8 | 5.2 | 2.6 | |
| Black 2 | | 2.64 | 8.5 | 3.1 | 24.1 | 5.2 | 2.7 | |
| Yellow 3 | Developer 3 | 1.87 | 6.4 | 2.9 | 38.9 | 5.2 | 2.8 | |
| Magenta 3 | | 1.68 | 6.5 | 2.6 | 40.1 | 5.2 | 2.9 | Inv. |
| Cyan 3 | | 1.73 | 6.4 | 2.7 | 42.1 | 5.2 | 2.6 | |
| Black 3 | | 1.85 | 7.4 | 2.5 | 42.8 | 5.2 | 2.7 | |
| Yellow 4 | Developer 4 | 1.86 | 8.9 | 2.1 | 19.8 | 5.2 | 2.7 | |
| Magenta 4 | | 1.89 | 9.9 | 1.9 | 17.6 | 5.2 | 2.7 | Inv. |
| Cyan 4 | | 1.83 | 9.6 | 1.9 | 18.8 | 5.2 | 2.6 | |
| Black 4 | | 1.74 | 10.2 | 1.7 | 17.9 | 5.2 | 2.8 | |
| Yellow 5 | Developer 5 | 2.78 | 4.1 | 6.7 | 33.1 | 5.2 | 2.9 | |
| Magenta 5 | | 2.67 | 4.5 | 5.9 | 25.8 | 5.2 | 2.9 | |
| Cyan 5 | | 2.29 | 3.8 | 6.1 | 29.6 | 5.2 | 2.3 | |
| Black 5 | | 2.31 | 4.0 | 5.8 | 30.1 | 5.2 | 2.4 | |
| Yellow 6 | Developer 6 | 2.67 | 3.7 | 7.2 | 2.7 | 5.2 | 7.2 | |
| Magenta 6 | | 2.65 | 3.9 | 6.8 | 2.6 | 5.2 | 6.8 | Comp. |
| Cyan 6 | | 2.63 | 3.9 | 6.7 | 2.7 | 5.2 | 6.1 | |
| Black 6 | | 2.65 | 4.0 | 6.6 | 2.5 | 5.2 | 6.7 | |
| Yellow 7 | Developer 7 | 1.68 | 3.8 | 4.4 | 32.0 | 5.2 | 2.8 | |
| Magenta 7 | | 1.66 | 3.7 | 4.5 | 31.2 | 5.2 | 2.9 | Inv. |
| Cyan 7 | | 1.64 | 3.8 | 4.3 | 31.4 | 5.2 | 2.6 | |
| Black 7 | | 1.67 | 3.9 | 4.3 | 33.0 | 5.2 | 2.7 | |
| Yellow 8 | Developer 8 | 1.69 | 3.6 | 4.7 | 31.9 | 5.2 | 2.6 | |
| Magenta 8 | | 1.67 | 3.5 | 4.8 | 31.6 | 5.2 | 2.4 | Inv. |
| Cyan 8 | | 1.66 | 3.7 | 4.5 | 31.5 | 5.2 | 2.5 | |
| Black 8 | | 1.69 | 3.8 | 4.4 | 34.1 | 5.2 | 2.7 | |

To the above-mentioned toners, ferrite carrier covered with a styrene-acrylic resin wherein the average particle size by volume was 65 $\mu$m and saturated magnetization was 65 emu/g was mixed so that developers having toner density of 7 weight % was prepared. Table 7 shows the number of developers.

By the use of the above-mentioned developers, evaluation was conducted under fixing conditions mentioned below.

As an evaluation machine, a color Copying machine 7728 produced by Konica having constitution shown in FIG. 3 was modified, and a fixing machine having the same outline as shown in FIG. 6 was used. The detail of modification related to the fixing conditions will be shown as below.

Incidentally, in the above-mentioned evaluation, the photoreceptor was charged to minus. Exposure was conducted by a semi-conductor laser depending upon image and development was conducted to the exposure section by a reversal developing system.

Heat roller fixing conditions

As a heat roller fixing method, there was a 30 mm upper roller 100, whose surface 200 was covered with a tetrafluoroethylene-perfluoroalkyl vinyl ether copolymer, composed of cylindrical iron, integrally housing a heater 400 in its central portion and there was also a 30 mm lower roller 500 constituted of silicone rubber whose surface was covered with a tetrafluoroethylene-perfluoroalkylether copolymer. Line pressure was set at 7N/cm, and nip width was 3.5 mm. In the use of the above-mentioned fixing means, the printing line speed was set at 100 mm/sec. Incidentally, as a cleaning mechanism of the fixing device, a roller impregnating the fluorine-containing silicone oil of the present invention was loaded and used. For the above-mentioned fluorine-containing silicone oil, illustrated compounds (3), (7), (8) and (13) were used. The heat roller fixing devices respectively employing them were defined to be R-1, R-2, R-3 and R-4. The surface temperature of upper roller 100 in the fixing device was 180° C.

In addition, in one test a silicone oil (a dimethyl silicone oil) composed of dimethylpolysiloxane was used in the above-mentioned device and in another test a fluorine-containing silicone oil (FS-1265, produced by Dow Corning Inc.) in which a side-chained fluorinated alkyl disclosed in Japanese Patent O.P.I. Publication No. 124338/1977 is a mere trifluoromethyl were used. A heat roller fixing device using a dimethyl silicone oil was defined to be R-6, and one using a fluorine-containing silicone oil (FS-1265: $R_f$=($CF_3$)) out of the present invention was defined to be R-5.

(Performance evaluation)

Offset property

With regard to the offset property, using the above-mentioned heat roller fixing device R-1–6, an image wherein pixel ratio would be 10% was printed using full color toner, i.e., yellow, magenta, cyan and black toner. Under the conditions of 33° C./80%RH, 20,000 sheets were copied. On a 1000 copies increment, a white paper was copied so that the existence of contamination on a white paper was evaluated. When no occurrence of offset was observed, it was defined to be excellent. When contamination was observed visually, the number of copy was shown in FIG. 8.

Transparency

Under conditions wherein the fixing temperature was set to 160° C., printing was conducted on a sheet for a overhead projector (PET base having 100 gm thickness), using a heat roller fixing device R-1 so that transparency was evaluated.

Table 8 shows the results thereof.

TABLE 8

| Developer | Releasing agent | Fixing device | Offset property | Transparency (%) | Remarks |
|---|---|---|---|---|---|
| Developer 1 | (3) | R-1 | excellent | 61 | Inv. |
| | (7) | R-2 | excellent | — | Inv. |

TABLE 8-continued

| Developer | Releasing agent | Fixing device | Offset property | Transparency (%) | Remarks |
|---|---|---|---|---|---|
| | (8) | R-3 | excellent | — | Inv. |
| | (13) | R-4 | excellent | — | Inv. |
| | A* | R-5 | 3000 | — | Comp. |
| | B* | R-6 | 4000 | — | Comp. |
| Developer 2 | (3) | R-1 | excellent | 62 | Inv. |
| | (7) | R-2 | excellent | — | Inv. |
| | (8) | R-3 | excellent | — | Inv. |
| | (13) | R-4 | excellent | — | Inv. |
| | A | R-5 | 3000 | — | Comp. |
| | B | R-6 | 4000 | — | Comp. |
| Developer 3 | (3) | R-1 | excellent | 61 | Inv. |
| | (7) | R-2 | excellent | — | Inv. |
| | (8) | R-3 | excellent | — | Inv. |
| | (13) | R-4 | excellent | — | Inv. |
| | A | R-5 | 3000 | — | Comp. |
| | B | R-6 | 4000 | — | Comp. |
| Developer 4 | (3) | R-1 | excellent | 62 | Inv. |
| | (7) | R-2 | excellent | — | Inv. |
| | (8) | R-3 | excellent | — | Inv. |
| | (13) | R-4 | excellent | — | Inv. |
| | A | R-5 | 3000 | — | Comp. |
| | B | R-6 | 4000 | — | Comp. |
| Developer 5 | (3) | R-1 | excellent | 43 | Inv. |
| | (7) | R-2 | excellent | — | |
| | (8) | R-3 | excellent | — | |
| | (13) | R-4 | excellent | — | |
| | A | R-5 | 3000 | — | |
| | B | R-6 | 4000 | — | |
| Developer 6 | (3) | R-1 | 17000 | 48 | Comp. |
| | (7) | R-2 | 17000 | — | |
| | (8) | R-3 | 16000 | — | |
| | (13) | R-4 | 16000 | — | |
| | A | R-5 | 2000 | — | |
| | B | R-6 | 3000 | — | |
| Developer 7 | (3) | R-1 | excellent | 60 | Inv. |
| | (7) | R-2 | excellent | — | Inv. |
| | (8) | R-3 | excellent | — | Inv. |
| | (13) | R-4 | excellent | — | Inv. |
| | A | R-5 | 7000 | — | Comp. |
| | B | R-6 | 7000 | — | Comp. |
| Developer 8 | (3) | R-1 | excellent | 60 | Inv. |
| | (7) | R-2 | excellent | — | Inv. |
| | (8) | R-3 | excellent | — | Inv. |
| | (13) | R-4 | excellent | — | Inv. |
| | A | R-5 | 9000 | — | Comp. |
| | B | R-6 | 9000 | — | Comp. |

*Inv.: Inventive sample
Comp.: Comparative sample
*A: Fluorine-containing silicone oil out of scope of the invention
B: Dimethyl silicone oil As is apparent from Table 8, it can be understood that, if the toner for developing an electrostatic image of the present invention and an image forming method are employed, an image excellent in terms of luster is formed as a color image and the occurrence of offset phenomenon can be avoided. Furthermore, a favorable image excellent in terms of transparency can be formed.

Example 3

Manufacturing colored particles

An emulsified dispersion having solid density of 20 weight % wherein a low-molecular-weight polypropylene (number average molecular weight of 3200) was emulsified in water by means of a surfactant while heating, was prepared. To 43 g of the above-mentioned low-molecular-weight polypropylene emulsified dispersion, 98.1 g of styrene monomer, 18.4 g of n-butylacrylate monomer, 6.1 g of methacrylic acid monomer, 3.3 g of t-dodecylmercaptane, dyes shown in the following Table and 850 ml of degassed pure water. Following this, the temperature of mixture was raised up to 70° C. while stirring under nitrogen air flow. Next, to the resulting mixture, 200 ml of pure water wherein 4.1 g of potassium persulfate was dissolved. At 70° C., the mixture was reacted for 6 hours. Then, the primary particle size of the resulting colored particle dispersion was measured (using a light dispersion electrical eternally-moving particle size measurer ELS-800, produced by Otsuka Electron Ind. Co.,). The following Table 9 shows the results thereof. To 600 ml of the above-mentioned dispersion, 160 ml of an aqueous 2.7 mol % of potassium chloride, 94 ml of isopropyl alcohol and 40 ml of pure water wherein 5.4 g of polyoxyethylene octylphenyl ether (the average ethylene oxide polymerization degree was 10) were added. Following this, the temperature of the mixture was raised to 85° C., and reacted for 6 hours. After completion of reaction, the reacted solution was filtrated, washed and dried to obtain colored particles of the present invention. These are defined to be colored particles. Incidentally, the added amount of dye was 4 wt % against the total monomer.

TABLE 9

| Colored particle number | Dye seed | Solubility in toluene (g/100 ml of toluene) | Solubility in water (weight %) |
|---|---|---|---|
| Colored particle 1 | C.I. Solvent yellow 24 | 0.4 | Not dissolved* |
| Colored particle 2 | C.I. Solvent yellow 98 | 2.0 | Not dissolved |
| Colored particle 3 | C.I. Solvent yellow 162 | 40.0 | Not dissolved |
| Colored particle 4 | C.I. Solvent Red 22 | 1.0 | Not dissolved |
| Colored particle 5 | C.I. Solvent Red 151 | 0.2 | Not dissolved |
| Colored particle 6 | C.I. Solvent Red 206 | 5.0 | Not dissolved |
| Colored particle 7 | C.I. Solvent Blue 92 | 0.02 | Not dissolved |
| Colored particle 8 | C.I. Solvent Blue 94 | 0.12 | Not dissolved |
| Colored particle 9 | C.I. Solvent Blue 97 | 12.5 | Not dissolved |
| Comparative colored particle 1 | C.I. Solvent yellow 17 | Not dissolved* | Not dissolved |
| Comparative colored particle 2 | C.I. Solvent yellow 57 | Not dissolved | Not dissolved |
| Comparative colored particle 3 | C.I. Solvent Red 122 | Not dissolved | Not dissolved |
| Comparative colored particle 4 | C.I. Solvent Red 30 | Not dissolved | Not dissolved |
| Comparative colored particle 5 | C.I. Solvent Blue 15:3 | Not dissolved | Not dissolved |
| Comparative colored particle 6 | C.I. Solvent Blue 48 | Not dissolved | Not dissolved |
| Comparative colored particle 7 | C.I. Solvent yellow 23 | 0.1 dissolved | Easily |

*Though solubility is apparently not more than 0.1 g/100 ml of toluene, solubility cannot be measured accurately.

Example of toner manufacturing

To each of the above-mentioned "colored particle 1" through "colored particle 9" and "comparative colored particle 1" through "comparative colored particle 7", 1 weight % of hydrophobic silica (primary average particle size of 12 nm) for obtaining toners. They are defined to be "toner 1" through "toner 9" and "comparative toner 1" through "comparative toner 7". The volume average particle size and the BET values of each toner will be described as follows.

TABLE 10

| Sample | Volume particle size (μm) | BET value | 2SD | Mw($10^4$) | Mn($10^3$) | Mw/Mn |
|---|---|---|---|---|---|---|
| Toner 1 | 5.60 | 21.9 | 2.6 | 1.69 | 3.7 | 4.6 |
| Toner 2 | 5.32 | 21.8 | 2.3 | 1.68 | 3.5 | 4.8 |
| Toner 3 | 5.21 | 23.7 | 2.4 | 1.67 | 3.6 | 4.6 |
| Toner 4 | 5.56 | 28.4 | 2.5 | 1.71 | 3.9 | 4.4 |
| Toner 5 | 6.23 | 14.9 | 2.4 | 1.72 | 4.1 | 4.2 |
| Toner 6 | 8.44 | 19.1 | 2.4 | 1.72 | 4.4 | 3.9 |
| Toner 7 | 6.76 | 27.4 | 2.5 | 1.71 | 4.3 | 4.0 |
| Toner 8 | 5.64 | 36.1 | 2.7 | 1.77 | 4.4 | 4.0 |
| Toner 9 | 4.34 | 27.1 | 2.2 | 1.78 | 4.3 | 4.1 |
| Comparative toner 1 | 5.81 | 23.7 | 2.8 | 1.78 | 4.4 | 4.0 |
| Comparative toner 2 | 6.21 | 19.1 | 2.9 | 1.72 | 4.1 | 4.2 |
| Comparative toner 3 | 5.62 | 26.3 | 2.8 | 1.72 | 4.3 | 4.0 |
| Comparative toner 4 | 5.91 | 26.1 | 2.5 | 1.76 | 4.4 | 4.0 |
| Comparative toner 5 | 6.01 | 27.1 | 2.6 | 1.77 | 4.5 | 3.9 |
| Comparative toner 6 | 5.82 | 26.0 | 2.7 | 1.77 | 4.3 | 4.1 |
| Comparative toner 7 | 3.60 | 21.8 | 2.8 | 1.71 | 4.4 | 3.9 |

For evaluation, the above-mentioned toners were mixed with ferrite carrier, whose volume average particle size was 50 μm, coated with a styrene-acrylic resin so that developers wherein toner density of 7 wt % was produced to be used. Incidentally, developers respectively corresponding to the above-mentioned "toner 1" through "toner 9" and "comparative toner 1" through "comparative toner 7" were defined to be "developer 1" through "developer 9" and "comparative developer 1" through "comparative developer 7".

With regard to an evaluation model, one wherein a modified color copying machine Konica 9028 produced by Konica Corporation was used. The conditions were shown as follows. As a photoreceptor, a lamination type organic photoreceptor was used.

Surface potential on the photoreceptor: −550V

DC bias: −250V

AC bias: Vp-p: −50 −450V

Alternating electrical field frequency: 1800 Hz

Dsd: 300 μm

Pressure regulating force: 10 gf/mm

Pressure regulating bar: SUS416 (produced of magnetic stainless)/diameter of 3 mm Developer thickness: 150 μm Development sleeve: 20 mm The constitution of the fixing device is as follows. There was a 30 mm upper roller, whose surface was covered with a tetrafluoroethylene-perfluoroalkyl vinyl ether copolymer, composed of cylindrical iron, integrally housing a heater in its central portion and there was also a 30 mm lower roller constituted of silicone rubber whose surface was covered with a tetrafluoroethylene-perfluoroalkylether copolymer. Line pressure was set at 0.8 kg/cm, and nip width was 4.3 mm. By the use of the above-mentioned fixing means, the printing line speed was set at 90 mm/sec. As a cleaning mechanism of the fixing device, a pad wherein a fluorine-containing silicone oil No. 13 was impregnated was loaded to be used. The surface temperature of the fixing means was 180° C.

By the use of each developer, 5 cm corner patches were printed on a 100 μm PET base. Using images after being fixed, light transmissivity was evaluated. Table 11 shows the results thereof.

TABLE 11

| Toner number | Transmission rate |
|---|---|
| Toner 1 | 78% |
| Toner 2 | 76% |
| Toner 3 | 88% |
| Toner 4 | 79% |
| Toner 5 | 73% |
| Toner 6 | 82% |
| Toner 7 | 72% |
| Toner 8 | 78% |
| Toner 9 | 80% |
| Comparative toner 1 | 48% |
| Comparative toner 2 | 44% |
| Comparative toner 3 | 42% |
| Comparative toner 4 | 40% |
| Comparative toner 5 | 46% |
| Comparative toner 6 | 42% |
| Comparative toner 7 | 78% |

Practically, with regard to light transmission rate, 70% or more is the practical level. All toners of the present invention are within this range. However, those not of the present invention were found to be out of the practical range. In the case of comparative toner, color was extremely thin, which might be caused by dissolving out of the dye.

Example 4

Manufacturing examples of colored particles will now be practically explained.

Example of manufacturing colored particles 1

(Manufacturing of colorant dispersion)

To a solution wherein 120 ml of pure water was dissolved in 4.92 g of sodium dodecylsulfate, 10.67 g of carbon black (Legal 330R, produced by Cabbot Inc.) processed with an aluminum coupling agent (Plain Act Al-M, produced by Ajinomoto). By applying ultrasonic wave while stirring, an aqueous dispersion of carbon black was produced.

(Manufacturing of a polyolefin emulsified dispersion)

To 500 ml of a high pressure reacting device provided with a stirrer, pure water polypropylene having a maleic acid anhydride and a nonionic surfactant were added. By the use of potassium hydroxide, pH was regulated. Applying pressure and temperature of the mixture were raised, and emulsified and dispersed at the softening point of the above-mentioned polypropylene or higher. The above-mentioned dispersed particle size of polypropylene (having a polar group) was measured, using a light scattering electrophoresis particle size analyzer ELS-800, produced by Otsuka Electron Ind. Co. and molecular weight distribution was measured in terms of styrene by GPC.

(Manufacturing of colored polymer particles)

In a 2 liters separable flask provided with a stirrer, a temperature sensor, a chilling tube and a nitrogen introduction tube, to the above-mentioned aqueous carbon black dispersion, 43 g of the resulting (WAX dispersion 1), 98.1 g of styrene monomer, 18.4 g of n-butylacrylate monomer, 6.1 g of methacrylic acid monomer, 3.3 g of a chain transfer agent and 850 ml of pure water subjected to degassing were added. Following this, while the resulting mixture was stirred under nitrogen gas flow, the temperature was raised to 70° C. Next, to the mixture, 200 ml of pure water wherein 4.1 g of potassium persulfate was dissolved was added. The resulting mixture was reacted at 70° C. for 6 hours. Thus, obtained carbon black containing colorant particles dispersion is defined to be dispersion 1. Incidentally, the primary particle size (a light scattering electrophoresis particle size analyzer ELS-800, produced by Otsuka Electron Ind. Co., was used) and molecular weight distribution was calculated by molecular weight in terms of styrene measured by GPC.

(Manufacturing of colored particle)

To 250 ml of the above-mentioned (dispersion 1), a 5N aqueous NaOH solution was added, and pH was regulated to be 9. The mixture was poured in a 500 ml separable flask provided with a stirrer, a chilling tube and a temperature sensor. The resulting mixture was stirred at 250 rpm at room temperature. To the mixture, an aqueous solution wherein 16.1 g of potassium chloride was dissolved in 65 ml of distilled water, 35 ml of isopropyl alcohol and an aqueous solution wherein 1.5 g of polyoxyethyleneoctylphenylether (the average polymerization degree of ethyleneoxide was 10) was dissolved in 20 ml of distilled water were added. Following this, the temperature was raised to 85° C., and the resulting mixture was reacted for 6 hours. After completion of reacting, the reacted solution was filtrated and subjected to suspension dispersion in a distilled water. By the use of an aqueous NaOH solution, pH was regulated to 13.

Following this, by repeating filtration and drying, a colored particle was obtained. This was defined to be colored particle 1. Incidentally, the average particle size (using a laser diffraction type Particle Size Distribution Analyzer SALD-1100, produced by Shimadzu Seisakusho) and the BET specific surface area (A BET specific surface area Analyzer Flow Sorb II 2300, produced by Shimadzu Seisakusho) of the above-mentioned colored particle were measured.

For measuring the domain size of polypropylene in a colored particle, the colored particle was enclosed with a light-hardenable resin, the resulting material was cut into a thin chip with a microtome (Ultracut E, produced by Reichert-Jung), photographed with a transmitting type microscope (LEM2000, produced by Topcom Co., Ltd.) and measured with an image processing apparatus (SUPICCA, produced by Nihon Abionics Co., Ltd.)

Manufacturing example of colored particle 2

In the same manner as in manufacturing example of colored particle 1 except that C.I. Pigment Blue 15:3 was used in stead of carbon black whose surface was processed, a colored particle was obtained. The dispersion obtained here was define to be dispersion 2, and the obtained colored particle was defined to be colored particle 2.

Manufacturing example of colored particles 3

In the same manner as in manufacturing example of colored particle 1 except that C.I. Pigment Red 122 was used in stead of carbon black whose surface was processed, a colored particle was obtained.

The dispersion obtained here was define to be dispersion 3, and the obtained colored particle was defined to be colored particle 3.

Manufacturing example of colored particle 4

In the same manner as in manufacturing example of colored particle 1 except that C.I. Pigment Yellow 17 was used in place of carbon black whose surface was processed, a colored particle was obtained. The dispersion obtained here was define to be dispersion 4, and the obtained colored particle was defined to be colored particle 4.

Manufacturing example of colored particle 5

In the same manner as in manufacturing example of colored particle 1 except that (WAX dispersion 2) was used, a colored particle was obtained. The dispersion obtained here was define to be dispersion 5, and the obtained colored particle was defined to be colored particle 5.

Manufacturing example of colored particle 6

In the same manner as in manufacturing example of colored particle 1 except that (WAX dispersion 3) was used, a colored particle was obtained. The dispersion obtained here was define to be dispersion 6, and the obtained colored particle was defined to be colored particle 6.

Manufacturing example of colored particles 7

In the same manner as in manufacturing example of colored particle 1 except that (WAX dispersion 4) was used, a colored particle was obtained. The dispersion obtained here was define to be dispersion 7, and the obtained colored particle was defined to be colored particle 7.

Manufacturing example of colored particles 8

In the same manner as in manufacturing example of colored particle 1 except that (WAX dispersion 5) was used, a colored particle was obtained. The dispersion obtained here was define to be dispersion 8, and the obtained colored particle was defined to be colored particle 8.

Manufacturing example of colored particles 9

In the same manner as in manufacturing example of colored particle 1 except that carnaba wax was used in place of (WAX dispersion 1), a colored particle was obtained. The dispersion obtained here was define to be dispersion 5, and the obtained colored particle was defined to be colored particle 5.

To the above-mentioned colored particles 1–9, 1 wt % of hydrophobic silica (the primary number average particle size was 12 nm) for obtaining toners 1–9. Each physical properties of WAX dispersions 1–5, dispersions 1–9, colored particles 1–9 and toners 1–9 will be shown in the following Tables.

TABLE 12

| Sample No. | Modified polypropylene: Weight avarage molecular weight (Mw) | Modified polypropylene: Acid number KOH mg/g | pH | Dispersed particle size (nm) |
|---|---|---|---|---|
| WAX dispersion 1 | $1.22 \times 10^4$ | 22 | 9.1 | 185 |
| WAX dispersion 2 | $1.47 \times 10^4$ | 43 | 8.9 | 93 |
| WAX dispersion 3 | $1.10 \times 10^4$ | 15 | 9.0 | 230 |
| WAX dispersion 4 | $1.38 \times 10^4$ | 20 | 8.0 | 342 |
| WAX dispersion 5 | $2.14 \times 10^4$ | 5 | 8.0 | 1210 |

TABLE 13

| Sample No. | Number average primarry particle size ($\mu$m) | Weight average molecular weight (Mw) $\times 10^4$ | Number average molecular weight (Mn) $\times 10^3$ | Mw/Mn |
|---|---|---|---|---|
| Dispersion 1 | 0.18 | 2.07 | 9.50 | 2.18 |
| Dispersion 2 | 0.25 | 1.85 | 8.81 | 2.10 |
| Dispersion 3 | 0.32 | 1.66 | 7.23 | 2.30 |
| Dispersion 4 | 0.48 | 1.98 | 8.79 | 2.26 |
| Dispersion 5 | 0.20 | 1.97 | 9.12 | 2.16 |
| Dispersion 6 | 0.19 | 1.99 | 9.00 | 2.21 |
| Dispersion 7 | 0.18 | 2.05 | 9.11 | 2.25 |
| Dispersion 8 | 0.21 | 2.03 | 9.27 | 2.19 |
| Dispersion 9 | 0.20 | 1.96 | 9.03 | 2.17 |

TABLE 14

| Sample No. | $d_{50}$ (μm) | BET specific surface area | WXA domain size (nm) | 2 SD |
|---|---|---|---|---|
| Colored particle 1 | 5.63 | 20.9 | 190 | 2.9 |
| Colored particle 2 | 5.90 | 21.3 | 182 | 2.2 |
| Colored particle 3 | 5.59 | 21.5 | 195 | 2.1 |
| Colored particle 4 | 6.21 | 20.7 | 186 | 2.8 |
| Colored particle 5 | 5.42 | 22.1 | 102 | 2.7 |
| Colored particle 6 | 5.79 | 22.5 | 224 | 2.6 |
| Colored particle 7 | 5.88 | 20.7 | 358 | 2.4 |
| Colored particle 8 | 5.77 | 21.2 | 1236 | 2.5 |
| Colored particle 9 | 5.62 | 20.0 | could not be detected | 2.8 |

$d_{50}$: Volume average particle size

<Example of manufacturing developers>

Next, in the resulting toners 1–9, ferrite carrier, whose average particle size by volume, laminated with a styrene-acrylic resin was mixed so that developers whose toner density was 7 wt % was prepared to define developers 1–9. By the use of the resulting developers 1–9, the following evaluations were conducted.

<Evaluation>

(Offset property)

With regard to developers 1–9 obtained as above, by adopting the heat roller fixing method shown in FIG. 6, the occurrence of offset was evaluated while varying the surface temperature of the fixing roller (the upper roller) from 110° to 230° C. Incidentally, a cleaning mechanism was not provided on the fixing device.

Line pressure: 7 N/cm

Nip width: 3.5 mm

Line speed of printing: 140 mm/sec.

For evaluation, an original having a full black portion having 10 mm width at the front edge of the image was used. After printing, the temperature was raised in an increment of 10° C. so that the occurrence of offset was evaluated. The temperature region where no offset occurred was shown as follows.

(Image contamination)

In addition, a fixing device whose roller temperature was fixed to 180° C. was used. Using the above-mentioned developers, a color copying machine produced by Konica 9028 was modified so that long running was conducted. The conditions are shown as follows. As the photoreceptor, a lamination type organic photoreceptor was used.

Surface potential on the photoreceptor: −550V

DC bias: −250V

AC bias: Vp-p: −50–−450V

Alternating electrical field frequency: 1800 Hz

Dsd: 300 μm

Pressure control force: 10 gf/mm

Pressure control bar: SUS416 (produced of magnetic stainless)/diameter of 3 mm

Developer thickness: 150 μm

Development sleeve: 20 mm

The circumstance conditions were normal temperature and low humidity (25° C./30%RH). An image wherein the pixel ratio was 5% was continuously copied for 100,000 sheets. After resting one night the condition of the occurrence of image contamination when a white paper was copied was visually evaluated.

A: No occurrence of fogging was observed. The condition was the same as that of the original white paper.

B: The occurrence of fogging was observed, though slightly.

C: The occurrence of fogging was noticeable.

Table 15 shows the results thereof.

TABLE 15

| Sample No. | Non-offset temperature region (°C.) | Occurrence of image contamination |
|---|---|---|
| Toner 1 | 110–230 | not exist |
| Toner 2 | 110–230 | not exist |
| Toner 3 | 110–230 | not exist |
| Toner 4 | 110–230 | not exist |
| Toner 5 | 110–230 | not exist |
| Toner 6 | 110–230 | not exist |
| Toner 7 | 110–230 | not exist |
| Toner 8 | 130–230 | exist |
| Toner 9 | 130–200 | exist |

not exist means that image contamination is completely not existed on an image.

exist means that toner generated on fixing member, is adhered on an image, and adhered toner can be observed by visual observation.

As is apparent from Table 15, it can be understood that temperature region where no offset occurs extends in the case of developers using the toner of the present invention and that contamination on the fixing roller has extremely been reduced such as that the occurrence of image contamination was not existed. Specifically, in the case of toners 1–7 wherein the domain size of polyolefin having a polar group in a molecule is within 10–1000 nm, no occurrence of image contamination was observed and there excellent offset property can be obtained.

Example 5

Example of manufacturing colored particles

Colored particles 1 through 9 were prepared in the same manner as in Example 3, except that the low-molecular-weight polypropylene (the number average molecular weight of 3,200) used in Example 3 was changed with the WAX dispersion 1 used in Example 4.

TABLE 16

| Colored particle number | Dye seed |
|---|---|
| Colored particle 1 C.I. | Solvent yellow 24 |
| Colored particle 2 | C.I. Solvent yellow 98 |
| Colored particle 3 | C.I. Solvent yellow 162 |
| Colored particle 4 | C.I. Solvent Red 22 |
| Colored particle 5 | C.I. Solvent Red 151 |
| Colored particle 6 | C.I. Solvent Red 206 |
| Colored particle 7 | C.I. Solvent Blue 92 |
| Colored particle 8 | C.I. Solvent Blue 94 |
| Colored particle 9 | C.I. Solvent Blue 97 |

Example of toner manufacturing

To each of the above-mentioned "colored particle" through "colored particle 9", 1 weight % of hydrophobic silica (primary number average particle size of 12 nm) was added so as to obtain toners 1 through 9 as follows. The volume average particle size, the BET specific surface value, 2SD, weight average molecular weight (Mw), number average molecular weight (Mn) and Mw/Mn of each toner will be described as follows.

TABLE 17

| Sample | Volume average particle size (μm) | BET value | 2 SD | Mw ($10^4$) | Mn ($10^3$) | Mw/Mn |
|---|---|---|---|---|---|---|
| Toner 1 | 5.51 | 22.1 | 2.5 | 1.68 | 3.8 | 4.4 |
| Toner 2 | 5.42 | 22.3 | 2.4 | 1.65 | 3.9 | 4.2 |
| Toner 3 | 5.22 | 23.9 | 2.5 | 1.71 | 4.5 | 3.8 |
| Toner 4 | 5.59 | 27.9 | 2.7 | 1.74 | 4.9 | 3.6 |
| Toner 5 | 6.45 | 12.1 | 3.1 | 1.77 | 4.6 | 3.8 |
| Toner 6 | 8.34 | 18.1 | 3.6 | 1.81 | 4.8 | 3.8 |
| Toner 7 | 6.78 | 26.4 | 3.2 | 1.89 | 4.8 | 3.9 |
| Toner 8 | 5.71 | 35.1 | 2.7 | 1.91 | 4.5 | 4.2 |
| Toner 9 | 4.54 | 29.1 | 2.2 | 1.91 | 4.6 | 4.2 |

For evaluation, the above-mentioned toners were mixed with ferrite carrier, whose average particle size by volume was 50 μm, coated with a styrene-acrylic resin so that developers wherein toner density was 7 wt % were produced to be used. Incidentally, developers respectively corresponding to the above-mentioned "Toner 1" through "Toner 9" were defined to be "developer 1" through "developer 9".

With regard to an evaluation model, one wherein a color copying machine Konica 9028 produced by Konica Corporation was modified was used. The conditions were shown as follows. As a photoreceptor, a lamination type organic photoreceptor was used.

Surface potential on the photoreceptor: −550V

DC bias: −250V

AC bias: Vp-p: −50 to −450V

Alternating electrical field frequency: 1800 Hz

Dsd: 300 μm

Pressure regulating force: 10 gf/mm

Pressure regulating bar: SUS416 (produced of magnetic stainless)/diameter of 3 μm Developer thickness: 150 pm Development sleeve: 20 mm The constitution of the fixing device is as follows. There was a 30 mm upper roller, whose surface was covered with a tetrafluoroethylene-perfluoroalkyl vinyl ether copolymer, composed of cylindrical iron, integrally housing a heater in its central portion and there was also a 30 mm lower roller of silicone rubber whose surface was covered with a tetrafluoroethylene-perfluoroalkylether copolymer. Line pressure was set at 0.8 kg/cm, and nip width was 4.3 mm. By the use of the above-mentioned fixing means, the printing line speed was set at 90 mm/sec. As a cleaning mechanism of the fixing device, a pad wherein a fluorine-containing silicone oil was impregnated was loaded to be used. The surface temperature of the fixing means was 180° C.

By the use of each developer, 5 cm corner patches were printed on a 100 μm PET base. Using images after being fixed, light transmission rate was evaluated. Table 18 shows the results thereof.

TABLE 18

| Toner number | Transmission rate | Offset property |
|---|---|---|
| Toner 1 | 77% | excellent |
| Toner 2 | 75% | excellent |
| Toner 3 | 87% | excellent |
| Toner 4 | 78% | excellent |
| Toner 5 | 71% | excellent |

TABLE 18-continued

| Toner number | Transmission rate | Offset property |
|---|---|---|
| Toner 6 | 79% | excellent |
| Toner 7 | 72% | excellent |
| Toner 8 | 78% | excellent |
| Toner 9 | 79% | excellent |

As apparent from Table 18, with regard to light transmission rate, 70% or more is the practical level. All toners 1 to 9 of the present invention are within this range, and further, all toners of the present invention show excellent results in Offset property.

What is claimed is:

1. A toner for developing an electrostatic latent image, said toner having a BET specific surface area of not less than 5 $m^2/g$, a particle size distribution (2SD) of not more than 5 μm, and an average particle size by volume of said toner of 2 to 10 μm.

2. The toner of claim 1, wherein said toner has a BET specific surface area of 5 to 150 $m^2/g$.

3. The toner of claim 1, wherein said toner has a BET specific surface area of 5 to 100 $m^2/g$.

4. The toner of claim 1, wherein said toner has a BET specific surface area of 5 to 50 $m^2/g$.

5. The toner of claim 1, wherein said toner comprises a colorant and a resin having a ratio (Mw/Mn) of a weight average molecular weight (Mw) to a number average molecular weight (Mn) of 1.5 through 100.

6. The toner of claim 5, wherein said ratio (Mw/Mn) is 1.8 through 70.

7. The toner of claim 1, wherein said toner comprises a styrene polymer and an oil-soluble dye having a solubility of not less than 0.01 g/100 ml of toluene and a water-solubility of not more than 0.1% by weight.

8. The toner of claim 1, wherein said toner comprises a polyolefin having a polar group in a molecule, and said polyolefin has a domain size of 10 through 1,000 nm.

9. The toner of claim 8, wherein said polyolefin has a domain size of 50 through 500 nm.

10. The toner of claim 8, wherein said polyolefin has an acid number of not more than 100 mg/g of KOH.

11. The toner of claim 9, wherein said polyolefin is a compound selected from the group consisting of α-olefin and a homologue of α-olefin.

12. The toner of claim 1, wherein said toner comprises a polyolefin having a polar group in a molecule, said polar group being a group selected from the group consisting of a sulfo group, a phospho group, a carboxyl group, an alkaline metal salt thereof, and an alkaline earth metal salt thereof.

13. The toner of claim 1 wherein said BET specific surface area is 5 through 50 $m^2/g$, and said toner comprises a polyolefin having a polar group.

14. The toner of claim 1, wherein said particle size distribution (2SD) of said toner is not more than 3 μm.

15. A developer for developing an electrostatic latent image, comprising a toner, wherein said toner has a BET specific surface area of not less than 5 $m^2/g$ and a particle size distribution (2SD) of not more than 5 μm.

* * * * *